US007719471B1

(12) United States Patent
Pavliscak et al.

(10) Patent No.: US 7,719,471 B1
(45) Date of Patent: May 18, 2010

(54) PLASMA-TUBE ANTENNA

(75) Inventors: Thomas J. Pavliscak, Palos Verdes Estates, CA (US); Carol Ann Wedding, Toledo, OH (US)

(73) Assignee: Imaging Systems Technology, Toledo, OH (US)

( * ) Notice: Subject to any disclaimer, the term of this patent is extended or adjusted under 35 U.S.C. 154(b) by 308 days.

(21) Appl. No.: 11/737,200

(22) Filed: Apr. 19, 2007

Related U.S. Application Data

(60) Provisional application No. 60/795,177, filed on Apr. 27, 2006.

(51) Int. Cl.
*H01Q 1/26* (2006.01)

(52) U.S. Cl. ..... 343/701

(58) Field of Classification Search ..... 343/701; 385/17, 31, 89
See application file for complete search history.

(56) References Cited

U.S. PATENT DOCUMENTS 3,515,932 A 6/1970 King
3,914,766 A 10/1975 Moore
4,260,994 A 4/1981 Parker
4,905,014 A 2/1990 Gonzalez et al.
4,977,352 A 12/1990 Williamson
5,182,496 A 1/1993 Manheimer et al.
5,323,169 A 6/1994 Koslover
5,418,431 A 5/1995 Williamson et al.
5,594,456 A 1/1997 Norris et al.
5,832,072 A 11/1998 Rozenbilt
5,846,883 A 12/1998 Moslehi
5,864,322 A 1/1999 Pollon et al.
5,952,980 A 9/1999 Boling
5,963,169 A 10/1999 Anderson et al.
5,982,334 A 11/1999 Manasson et al.
5,990,837 A 11/1999 Norris et al.
6,028,324 A 2/2000 Su et al.
6,046,705 A 4/2000 Anderson
6,087,992 A 7/2000 Anderson
6,087,993 A 7/2000 Anderson et al.
6,118,407 A 9/2000 Anderson
6,164,241 A 12/2000 Chen et al.
6,169,520 B1 1/2001 Anderson
6,271,810 B1 8/2001 Yoo et al.
6,316,777 B1 11/2001 Parrish et al.
6,369,763 B1 4/2002 Norris et al.
6,492,951 B1 12/2002 Harris et al.
6,512,496 B2 1/2003 Alexeff et al.
6,540,180 B2 4/2003 Anderson
6,624,719 B1 9/2003 Anderson et al.
6,650,297 B2 11/2003 Anderson et al.
6,657,594 B2 12/2003 Anderson
6,674,970 B1 1/2004 Anderson
6,677,913 B2 1/2004 Engargiola et al.
6,700,544 B2 3/2004 Anderson
6,710,746 B1 3/2004 Anderson et al.
6,806,833 B2 10/2004 Anderson (Continued)

*Primary Examiner*—Huedung Mancuso
(74) *Attorney, Agent, or Firm*—Donald K. Wedding

(57) ABSTRACT

A gas plasma antenna with a rigid, flexible or semi-flexible substrate and an improved method of generating a uniform electron density. The antenna comprises a plasma display panel (PDP) containing a multiplicity of Plasma-tubes, each Plasma-tube containing a gas, which is ionized to produce electron density. A selected portion of each Plasma-tube acts alone or in concert with a selected portion of other Plasma-tubes to form a dipole or pattern of dipoles.

18 Claims, 15 Drawing Sheets

U.S. PATENT DOCUMENTS 6,812,895 B2 11/2004 Anderson et al.
6,825,814 B2 11/2004 Hayes
6,842,146 B2 1/2005 Alexeff et al.
6,843,178 B2 1/2005 Wood et al.
6,856,301 B2 * 2/2005 Walker et al. ..... 343/853
6,870,517 B1 3/2005 Anderson
6,876,330 B2 4/2005 Anderson et al.
6,879,289 B2 4/2005 Hayes
6,922,173 B2 7/2005 Anderson
6,952,189 B2 10/2005 Engargiola et al.
7,068,226 B1 6/2006 Mitra
7,109,124 B2 9/2006 Harper
7,145,512 B2 12/2006 Metz
7,225,740 B1 6/2007 Wood et al.
7,262,734 B2 8/2007 Wood
7,274,333 B1 9/2007 Alexeff
7,292,191 B2 11/2007 Anderson
7,340,025 B2 3/2008 Melin et al.
7,342,549 B2 3/2008 Anderson
7,367,281 B2 5/2008 Lee
7,482,273 B1 * 1/2009 Klein et al. ..... 438/676
2001/0033207 A1 10/2001 Anderson et al.
2002/0093460 A1 7/2002 Alexeff et al.
2003/0142021 A1 7/2003 Anderson
2003/0146879 A1 8/2003 Anderson
2003/0160724 A1 8/2003 Alexeff et al.
2003/0193435 A1 10/2003 Anderson et al.
2003/0193436 A1 10/2003 Anderson
2003/0218575 A1 * 11/2003 Walker et al. ..... 343/853
2004/0041741 A1 3/2004 Hayes
2004/0061650 A1 4/2004 Anderson et al.
2004/0130497 A1 7/2004 Alexeff et al.
2004/0227682 A1 11/2004 Anderson
2005/0057432 A1 3/2005 Anderson
2005/0084996 A1 4/2005 Harper
2005/0110691 A1 5/2005 Anderson
2005/0183668 A1 8/2005 Lee
2005/0280372 A1 12/2005 Anderson
2006/0220980 A1 10/2006 Metz
2007/0036492 A1 * 2/2007 Lee ..... 385/89
2007/0044674 A1 3/2007 Wood
2007/0163500 A1 7/2007 Kim et al.
2007/0263759 A1 11/2007 Melin et al.
2007/0285022 A1 12/2007 Anderson

* cited by examiner $L_v$ = DIPOLE LENGTH – VERTICAL POL
$L_h$ = DIPOLE LENGTH – HORIZONTAL POL
T = DIPOLE THICKNESS
$\varepsilon$ = DIELECTRIC CONSTANT Section A-A View Section A-A View Section B-B View

PLASMA-TUBE ANTENNA

RELATED APPLICATIONS

Priority is claimed under 35 U.S.C. 119(e) for Provisional Patent Application Ser. No. 60/795,177 filed Apr. 27, 2006.

INTRODUCTION

This invention relates to phased array antennas, including dynamic gas plasma driven phased array antennas. This invention particularly relates to a plasma display panel (PDP) antenna constructed out of one or more Plasma-tubes filled with an ionizable gas. The PDP antenna comprises one or more Plasma-tubes on or within a rigid, flexible, or semi-flexible substrate with each Plasma-tube being electrically connected to at least two electrical conductors such as electrodes. A selected portion of each gas-filled Plasma-tube acts as a dipole alone or in concert with a selected portion of other gas-filled Plasma-tubes to form dipole patterns.

The Plasma-tube may be used alone or in combination with Plasma-shells. As used herein, Plasma-shell includes Plasma-disc, Plasma-dome, and Plasma-sphere. Combinations of different Plasma-shells may be used.

Plasma Panel Background

PDP Structures and Operation

In a gas discharge plasma display panel (PDP), a single addressable picture element is a cell, sometimes referred to as a pixel. In a multicolor PDP, two or more cells or pixels may be addressed as sub-cells or sub-pixels to form a single cell or pixel. As used herein cell or pixel means sub-cell or sub-pixel. The cell or pixel element is defined by two or more electrodes positioned in such a way so as to provide a voltage potential across a gap containing an ionizable gas. When sufficient voltage is applied across the gap, the gas ionizes to produce light. In an AC gas discharge plasma display, the electrodes at a cell site are coated with a dielectric. The electrodes are generally grouped in a matrix configuration to allow for selective addressing of each cell or pixel.

To form a display image, several types of voltage pulses may be applied across a plasma display cell gap. These pulses include a write pulse, which is the voltage potential sufficient to ionize the gas at the pixel site. A write pulse is selectively applied across selected cell sites. The ionized gas will produce visible light, UV and/or IR light. The ionized gas can also be used in combination with phosphors to produce various colors. Sustain pulses are a series of pulses that produce a voltage potential across pixels to maintain ionization of cells previously ionized by the write pulse. An erase pulse is used to selectively extinguish ionized pixels.

The voltage at which a pixel will ionize, sustain, and erase depends on a number of factors including the distance between the electrodes, the composition of the ionizing gas, and the pressure of the ionizing gas. Also of importance is the dielectric composition and thickness. To maintain uniform electrical characteristics throughout the display it is desired that the various physical parameters adhere to required tolerances. Maintaining the required tolerance depends on cell geometry, fabrication methods and the materials used. The prior art discloses a variety of plasma display structures, a variety of methods of construction, and materials.

Examples of open cell gas discharge (plasma) devices include both monochrome (single color) AC plasma displays and multi-color (two or more colors) AC plasma displays. Also monochrome and multicolor DC plasma displays are contemplated.

Examples of monochrome AC gas discharge (plasma) displays are well known in the prior art and include those disclosed in U.S. Pat. Nos. 3,559,190 (Bitzer et al.), 3,499,167 (Baker et al.), 3,860,846 (Mayer), 3,964,050 (Mayer), 4,080,597 (Mayer), 3,646,384 (Lay), and 4,126,807 (Wedding), all incorporated herein by reference.

Examples of multicolor AC plasma displays are well known in the prior art and include those disclosed in U.S. Pat. Nos. 4,233,623 issued to (Pavliscak), 4,320,418 (Pavliscak), 4,827,186 (Knauer, et al.), 5,661,500 (Shinoda et al.), 5,674,553 (Shinoda, et al.), 5,107,182 (Sano et al.), 5,182,489 (Sano), 5,075,597 (Salavin et al.), 5,742,122 (Amemiya et al. 5,640,068 (Amemiya et al.), 5,736,815 (Amemiya), 5,541,479 (Nagakubi), 5,745,086 (Weber), and 5,793,158 (Wedding), all incorporated herein by reference.

This invention may be practiced in a DC gas discharge (plasma) display which is well known in the prior art, for example as disclosed in U.S. Pat. Nos. 3,886,390 (Maloney et al.), 3,886,404 (Kurahashi et al.), 4,035,689 (Ogle et al.), and 4,532,505 (Holz et al.), all incorporated herein by reference.

This invention will be described with reference to an AC plasma display. The PDP industry has used two different AC plasma display panel (PDP) structures, the two-electrode columnar discharge structure and the three-electrode surface discharge structure. Columnar discharge is also called co-planar discharge.

Columnar PDP

The two-electrode columnar or co-planar discharge plasma display structure is disclosed in U.S. Pat. Nos. 3,499,167 (Baker et al.) and 3,559,190 (Bitzer et al.). The two-electrode columnar discharge structure is also referred to as opposing electrode discharge, twin substrate discharge, or co-planar discharge. In the two-electrode columnar discharge AC plasma display structure, the sustaining voltage is applied between an electrode on a rear or bottom substrate and an opposite electrode on the front or top viewing substrate. The gas discharge takes place between the two opposing electrodes in between the top viewing substrate and the bottom substrate.

The columnar discharge PDP structure has been widely used in monochrome AC plasma displays that emit orange or red light from a neon gas discharge. Phosphors may be used in a monochrome structure to obtain a color other than neon orange.

In a multi-color columnar discharge PDP structure as disclosed in U.S. Pat. No. 5,793,158 (Wedding), phosphor stripes or layers are deposited along the barrier walls and/or on the bottom substrate adjacent to and extending in the same direction as the bottom electrode. The discharge between the two opposite electrodes generates electrons and ions that bombard and deteriorate the phosphor thereby shortening the life of the phosphor and the PDP.

In a two electrode columnar discharge PDP as disclosed by Wedding (158), each light emitting pixel is defined by a gas discharge between a bottom or rear electrode x and a top or front opposite electrode y, each cross-over of the two opposing arrays of bottom electrodes x and top electrodes y defining a pixel or cell.

Surface Discharge PDP

The three-electrode multi-color surface discharge AC plasma display panel structure is widely disclosed in the prior art including U.S. Pat. Nos. 5,661,500 (Shinoda et al.), 5,674, 553 (Shinoda et al.), 5,745,086 (Weber), and 5,736,815 (Amemiya), all incorporated herein by reference.

In a surface discharge PDP, each light emitting pixel or cell is defined by the gas discharge between two electrodes on the top substrate. In a multi-color RGB display, the pixels may be called sub-pixels or sub-cells. Photons from the discharge of an ionizable gas at each pixel or sub-pixel excite a photoluminescent phosphor that emits red, blue, or green light.

In a three-electrode surface discharge AC plasma display, a sustaining voltage is applied between a pair of adjacent parallel electrodes that are on the front or top viewing substrate. These parallel electrodes are called the bulk sustain electrode and the row scan electrode. The row scan electrode is also called a row sustain electrode because of its dual functions of address and sustain. The opposing electrode on the rear or bottom substrate is a column data electrode and is used to periodically address a row scan electrode on the top substrate. The sustaining voltage is applied to the bulk sustain and row scan electrodes on the top substrate. The gas discharge takes place between the row scan and bulk sustain electrodes on the top viewing substrate.

In a three-electrode surface discharge AC plasma display panel, the sustaining voltage and resulting gas discharge occurs between the electrode pairs on the top or front viewing substrate above and remote from the phosphor on the bottom substrate. This separation of the discharge from the phosphor minimizes electron bombardment and deterioration of the phosphor deposited on the walls of the barriers or in the grooves (or channels) on the bottom substrate adjacent to and/or over the third (data) electrode. Because the phosphor is spaced from the discharge between the two electrodes on the top substrate, the phosphor is subject to less electron bombardment than in a columnar discharge PDP.

Single Substrate PDP

There may be used a PDP structure having a so-called single substrate or monolithic plasma display panel structure having one substrate with or without a top or front viewing envelope or dome. Single-substrate or monolithic plasma display panel structures are well known in the prior art and are disclosed by U.S. Pat. Nos. 3,646,384 (Lay), 3,652,891 (Janning), 3,666,981 (Lay), 3,811,061 (Nakayama et al.), 3,860,846 (Mayer), 3,885,195 (Amano), 3,935,494 (Dick et al.), 3,964,050 (Mayer), 4,106,009 (Dick), 4,164,678 (Biazzo et al.), and 4,638,218 (Shinoda), all incorporated herein by reference.

Antenna Background

Phased array antennas are known in the prior art, for example, as disclosed in U.S. Pat. No. 4,905,014 (Gonzalez et al.). In general, a microwave phasing structure includes a support matrix, i.e., a dielectric substrate, and a reflective means, i.e., a ground plane, for reflecting microwaves within the frequency-operating band. The reflective means is supported by a support matrix. An arrangement of electromagnetically loading structures is supported by the support matrix at a distance from the reflective means, which can be less than a fraction of the wavelength of the highest frequency in the operating frequency range. The electromagnetically loading structures are dimensioned, oriented, and interspaced from each other and disposed at a distance from the reflective means, as to provide the emulation of the desired reflective surface of selected geometry. Specifically, the electromagnetically loading structures form an array of metallic patterns, each metallic pattern preferably being in the form of a cross, i.e., X configuration. It is disclosed that each electromagnetically loading structure can be constructed to form different geometrical patterns and, in fact, could be shorted crossed dipoles, metallic plates, irises, apertures, etc. It is further disclosed that the microwave phasing structures of the Gonzalez et al. (014) patent may be used for electromagnetically emulating a desired microwave-focusing element of a selected geometry.

The selected geometry of the desired reflective surface can be a parabolic surface in order to emulate a parabolic reflector wherein all path lengths of the reflected incident electromagnetic waves are equalized by phase shifting affected by the microwave phasing structure of the present invention. While the microwave phasing structure may emulate desired reflective surfaces of selected geometries such as a parabola, the microwave phasing structure is generally flat in shape. However, the shape of the microwave phasing structure may be conformal to allow for mounting on substantially non-flat surfaces.

RELATED PRIOR ART

Tubes

The construction of a PDP out of gas-filled hollow tubes is know in the prior art. The following prior art references relate to the use of tubes in a PDP and are incorporated herein by reference.

U.S. Pat. No. 3,602,754 (Pfaender et al.) discloses a multiple discharge gas display panel in which filamentary or capillary size glass tubes are assembled and formed as a monolayer to form a gas discharge panel.

U.S. Pat. Nos. 3,654,680 (Bode et al.), 3,927,342 (Bode et al.) and 4,038,577 (Bode et al.) disclose a gas discharge display in which filamentary or capillary size gas tubes are assembled to form a gas discharge panel.

U.S. Pat. No. 3,969,718 (Strom) discloses a plasma display system utilizing tubes arranged in a side-by-side, parallel fashion.

U.S. Pat. No. 3,990,068 (Mayer et al.) discloses a capillary tube plasma display with a plurality of capillary tubes arranged parallel in a close pattern.

U.S. Pat. No. 4,027,188 (Bergman) discloses a tubular plasma display consisting of parallel glass capillary tubes sealed in a plenum and attached to a rigid substrate.

U.S. Pat. No. 5,984,747 (Bhagavatula et al.) discloses rib structures for containing plasma in electronic displays are formed by drawing glass preforms into fiber-like rib components. The rib components are then assembled to form rib/channel structures suitable for flat panel displays.

U.S. Patent Application Publication 2001/0028216A1 (Tokai et al.) discloses a group of elongated illuminators in a gas discharge device.

U.S. Pat. No. 6,255,777 (Kim et al.) and U.S. Patent Application Publication 2002/0017863 (Kim et al.), disclose a capillary electrode discharge PDP device and a method of fabrication.

U.S. Pat. Nos. 6,633,117 (Shinoda et al.), 6,650,055 (Ishimoto et al.), and 6,677,704 (Ishimoto et al.), disclose a PDP with elongated display tubes, all incorporated herein by reference.

European Patent 1,288,993 (Ishimoto et al.) also discloses a PDP with elongated display tubes and is incorporated herein by reference.

The following U.S. Patents by Fujitsu Ltd. of Kawasaki disclose PDP structures with elongated display tubes and are incorporated by reference, U.S. Pat. Nos.
6,914,382 (Ishimoto et al.), 6,893,677 (Yamada et al.),
6,857,923 (Yamada et al.),
6,841,929 (Ishimoto et al.),
6,836,064 (Yamada et al.),
6,836,063 (Ishimoto et al.),
6,794,812 (Yamada et al.),
6,677,704 (Ishimoto et al.),
6,650,055 (Ishimoto et al.),
6,633,117 (Shinoda et al.),
6,930,442 (Awamoto et al.),
6,932,664 (Yamada et al.),
6,969,292 (Tokai et al.),
7,049,748 (Tokai et al.), and
7,083,681 (Yamada et al.).

The following U.S. Patent Applications Publications by Fujitsu Ltd. of Kawasaki, Japan disclose PDP structures with elongated display tubes and are incorporated herein by reference, U.S. Patent Application Publication Nos.;
2004/0033319 (Yamada et al.) and
2003/0182967 (Tokai et al.).

As used herein elongated tube is intended to include capillary, filament, filamentary, illuminator, hollow rods, or other such terms. It includes an elongated enclosed gas-filled structure having a length dimension that is greater than its cross-sectional width dimension. The width of the tube is typically the viewing direction of the display. Also as used herein, an elongated Plasma-tube has multiple gas discharge pixels of 100 or more, typically 500 to 1000 or more, whereas a Plasma-shell typically has only one gas discharge pixel. In some special embodiments, the Plasma-shell may have more than one pixel, i.e., 2, 3, or 4 pixels up to 10 pixels.

RELATED PRIOR ART

Spheres, Beads, Ampoules, Capsules

The construction of a PDP out of gas-filled hollow microspheres is known in the prior art. Such microspheres are referred to as spheres, beads, ampoules, capsules, bubbles, shells, and so forth. The following prior art relates to the use of microspheres in a PDP and are incorporated herein by reference.

U.S. Pat. No. 2,644,113 (Etzkorn) discloses ampoules or hollow glass beads containing luminescent gases that emit a colored light. In one embodiment, the ampoules are used to radiate ultraviolet light onto a phosphor external to the ampoule itself.

U.S. Pat. No. 3,848,248 (MacIntyre) discloses the embedding of gas-filled beads in a transparent dielectric. The beads are filled with a gas using a capillary. The external shell of the beads may contain phosphor.

U.S. Pat. No. 3,998,618 (Kreick et al.) discloses the manufacture of gas-filled beads by the cutting of tubing. The tubing is cut into ampoules (shown as domes in FIG. 2) and heated to form shells. The gas is a rare gas mixture, 95% neon, and 5% argon at a pressure of 300 Torr. U.S. Pat. No. 4,035,690 (Roeber) discloses a plasma panel display with a plasma forming gas encapsulated in clear glass shells. Roeber used commercially available glass shells containing gases such as air, $SO_2$ or $CO_2$ at pressures of 0.2 to 0.3 atmosphere. Roeber (690) discloses the removal of these residual gases by heating the glass shells at an elevated temperature to drive out the gases through the heated walls of the glass shell. Roeber obtains different colors from the glass shells by filling each shell with a gas mixture, which emits a color upon discharge, and/or by using a glass shell made from colored glass.

U.S. Pat. No. 4,963,792 (Parker) discloses a gas discharge chamber including a transparent dome portion.

U.S. Pat. No. 5,326,298 (Hotomi) discloses a light emitter for plasma light emission. The light emitter comprises a resin including fine bubbles in which a gas is trapped. The gas is selected from rare gases, hydrocarbons, and nitrogen.

Japanese Patent 11238469A, published Aug. 31, 1999, by Tsuruoka Yoshiaki of Dainippon discloses a plasma display panel containing a gas capsule. The gas capsule is provided with a rupturable part, which ruptures when it absorbs a laser beam.

Also incorporated by reference is U.S. Pat. No. 6,864,631 (Wedding) that discloses a PDP comprised of microspheres filled with an ionizable gas.

RELATED PRIOR ART

Light Emitting Elements

U.S. Pat. No. 6,545,422 (George et al.) discloses a light-emitting plasma display panel with a plurality of sockets with spherical or other shape micro-components in each socket sandwiched between two substrates. The micro-component includes a shell filled with a plasma-forming gas or other material. The light-emitting panel may be a plasma display, electroluminescent display, or other display device.

The following U.S. patents issued to George et al. and the various joint inventors are incorporated herein by reference:
U.S. Pat. Nos. 6,570,335 (George et al.),
6,612,889 (Green et al.),
6,620,012 (Johnson et al.),
6,646,388 (George et al.),
6,762,566 (George et al.),
6,764,367 (Green et al.),
6,791,264 (Green et al.),
6,796,867 (George et al.),
6,801,001 (Drobot et al.),
6,822,626 (George et al.),
6,902,456 (George et al.),
6,935,913 (Wyeth et al.),
6,975,068 (Green et al.),
7,005,793 (George et al.),
7,025,648 (Green et al.),
7,125,305 (Green et al.), and
7,137,857 (George et al.).

Also incorporated herein by reference are the following U.S. Patent Application Publication Nos.:
2004/0063373 (Johnson et al.),
2005/0095944 (George et al.),
2006/0097620 (George et al.), and
2006/0205311 (Green et al.).

Radio Frequency

The Plasma-tubes and/or Plasma-shells may be operated with radio frequency (RF). The RF may especially be used to sustain the plasma discharge. RF may also be used to operate the Plasma-tubes and/or Plasma-shells with a positive column discharge. The use of RF in a PDP is disclosed in the following prior art, all incorporated herein by reference.
U.S. Pat. Nos. 6,271,810 (Yoo et al.),
6,340,866 (Yoo),
6,473,061 (Lim et al.),
6,476,562 (Yoo et al.),
6,483,489 (Yoo et al.),
6,501,447 (Kang et al.),
6,605,897 (Yoo), 6,624,799 (Kang et al.),
6,661,394 (Choi),
6,794,820 (Kang et al.),
7,122,961 (Wedding),
7,157,854 (Wedding), and
7,126,628 (Wedding).

RELATED PRIOR ART

Antennas

U.S. Pat. Nos. 4,905,014 (Gonzales et al.) and 5,864,322 (Pollon et al.), relates to antennas and are incorporated herein by reference.

SUMMARY OF INVENTION

This invention relates to a PDP antenna constructed out of one or more Plasma-tubes on or within a rigid or flexible substrate with each Plasma-tube being electrically connected to at least two electrical conductors such as electrodes. In accordance with one embodiment of this invention, insulating barriers are used to prevent contact between the electrodes. The Plasma-tube may be used alone or in combination with one or more Plasma-shells. The Plasma-shell may be of any suitable geometric shape such as a Plasma-sphere, Plasma-disc, or Plasma-dome suitable for use in a gas discharge plasma display device. As used herein, Plasma-shell includes Plasma-sphere, Plasma-disc, and/or Plasma-dome. Combinations of different Plasma-shells may be used in the PDP with the Plasma-tube.

A Plasma-sphere is a primarily hollow sphere with relatively uniform shell thickness. The shell is typically composed of a dielectric material. It is filled with an ionizable gas at a desired mixture and pressure. The gas is selected to produce visible, UV, and/or infrared discharge when a voltage is applied. The shell material is selected to optimize dielectric properties and optical transmissivity. Additional beneficial materials may be added to the inside or outer surface of the sphere including magnesium oxide for secondary electron emission. The magnesium oxide and other materials including organic and/or inorganic luminescent substances may also be added directly to the shell material.

A Plasma-disc is similar to the Plasma-sphere in material composition and gas selection. It differs from the Plasma-sphere in that it is flattened on both the top and bottom. A Plasma-sphere or sphere may be flattened to form a Plasma-disc by applying heat and pressure simultaneously to the top and bottom of the sphere using two substantially flat and ridged members, either of which may be heated. The Plasma-disc may have sides or edges, which are round, curved, flat, or angled. The top and bottom are substantially flat and may have one or more flattened sides. The top and bottom can be substantially the same area or be different areas. The top and bottom can be substantially parallel to one another or not parallel to one another.

A Plasma-dome is similar to a Plasma-sphere in material composition and ionizable gas selection. It differs in that one side is domed. A Plasma-sphere is flattened on one or more other sides to form a Plasma-dome, typically by applying heat and pressure simultaneously to the top and bottom of the Plasma-sphere or sphere using one substantially flat and ridged member and one substantially elastic member. In one embodiment, the substantially rigid member is heated. A Plasma-dome may also be made by cutting an elongated tube as shown in U.S. Pat. No. 3,998,618 (Kreick et al.), incorporated herein by reference.

In accordance with this invention, there is provided a phased array plasma antenna characterized by a plurality of localized gas discharge areas, each gas area being selectively ionized by energizing means to form a reflector to incident radiation, each localized gas discharge area being within a gas encapsulating Plasma-tube, each affixed to a substrate, at least two electrodes being in contact with each gas encapsulating Plasma-tube, said electrodes being affixed to or embedded within the substrate, and electronic circuitry including PDP addressing and sustain waveform electronics for addressing and sustaining each Plasma-tube. The Plasma-tubes are mounted on or within a substrate that is rigid, flexible, or semi-flexible.

Each localized ionized gas discharge area within a Plasma-tube acts alone or in concert with other localized ionized gas discharge areas to form dipoles or patterns of dipoles. More particularly, a selected portion of the ionized gas within a Plasma-tube acts as a dipole or acts in concert with a selected portion or portions of the ionized gas within one or more other Plasma-tubes to form a dipole or dipole patterns. The position, length, and/or spacing of dipoles are selected to efficiently reflect incident radiation at a desired angle. In another embodiment, a ground plane structure resides on one or more layers on the substrate. In another embodiment, the electronic circuitry is characterized by a high frequency voltage component, ranging from about 1 megahertz to about 100 megahertz. Higher frequency ranges up to 500 megahertz are contemplated. Likewise lower frequencies below 1 megahertz are contemplated. For high frequencies, a tank circuit may be used for efficiency.

In another embodiment, the phasing arrangement further includes a plurality of ionized plasma areas, each ionized plasma area being disposed a first distance from the reflective means and having a size associated therewith, each ionized plasma area further being disposed a second distance from each adjacent ionized plasma area, whereby each ionized plasma area, in cooperation with the reflective means, generates a portion of a reflected RF beam having a phase shift imparted thereon in response to an incident RF beam so as to generate a composite RF beam having a scan angle associated therewith.

In another embodiment, at least first and second ionized plasma areas provide a composite phase shift from the combination of the phase shifts respectively provided by each of the individual ionized plasma areas such that the composite shift may be dynamically varied by dynamically varying the size and shape of at least one of the first and second ionized plasma areas.

In another embodiment, there is provided a radio frequency (RF) phasing structure for electromagnetically emulating a desired reflective surface of selected geometry over at least one operating frequency band, comprising:

reflective means for reflecting energy of an incident RF beam within the at least one frequency band;

a phasing arrangement of at least one plasma structure being operatively coupled to the reflective means, the at least one plasma structure including at least one gas containing area which is reflective at the at least one operating frequency range, when ionized, forming at least one ionized plasma area, the ionized plasma area being disposed a distance from the reflective means and having a size associated therewith whereby the phasing structure generates a reflected RF beam with a phase shift imparted thereon in response to the incident RF beam so as to provide the emulation of the desired reflective surface of selected geometry; and a control circuit for dynamically varying the size of the at least one ionized plasma area such that the phase shift imparted on the reflected RF beam dynamically varies so that the reflected RF beam is electronically scanned.

In another embodiment of the phasing structure, each ionized plasma area is disposed, with respect to adjacent ionized plasma areas, a distance equivalent to approximately one half of a wavelength associated with the at least one operating frequency band.

In another embodiment of the phasing structure, a second reflective means is disposed a distance from the ionized plasma areas for reflecting energy of an incident RF beam within a second operating frequency band.

DETAILED DESCRIPTIONS OF THE DRAWINGS

Figure 1A:
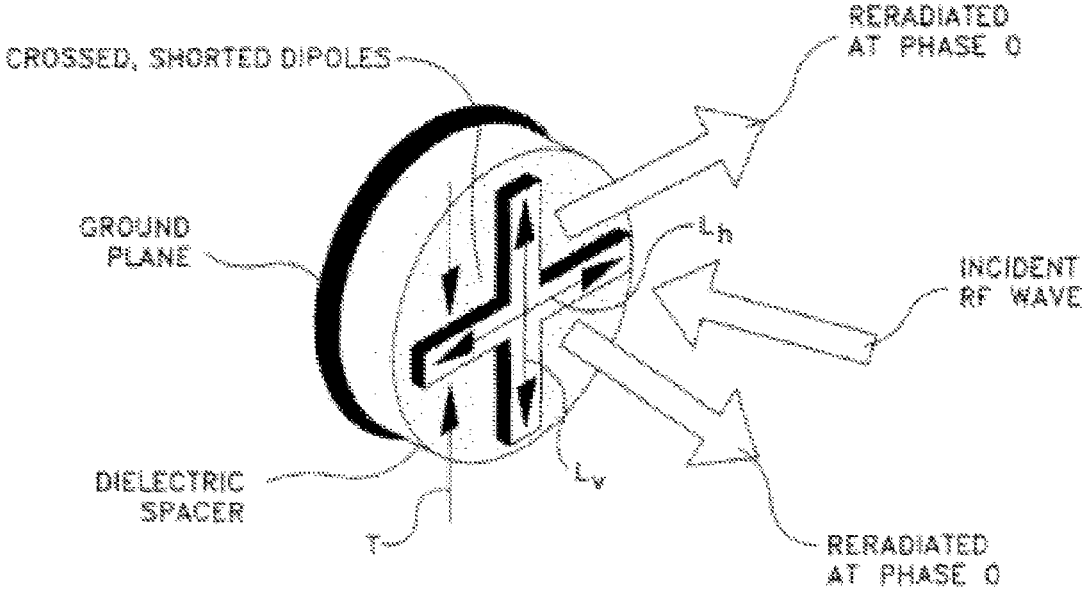
Figure 1A Prior Art
FIG. 1A is a perspective view of a conventional radiating element (Prior Art).
Figure 1B:
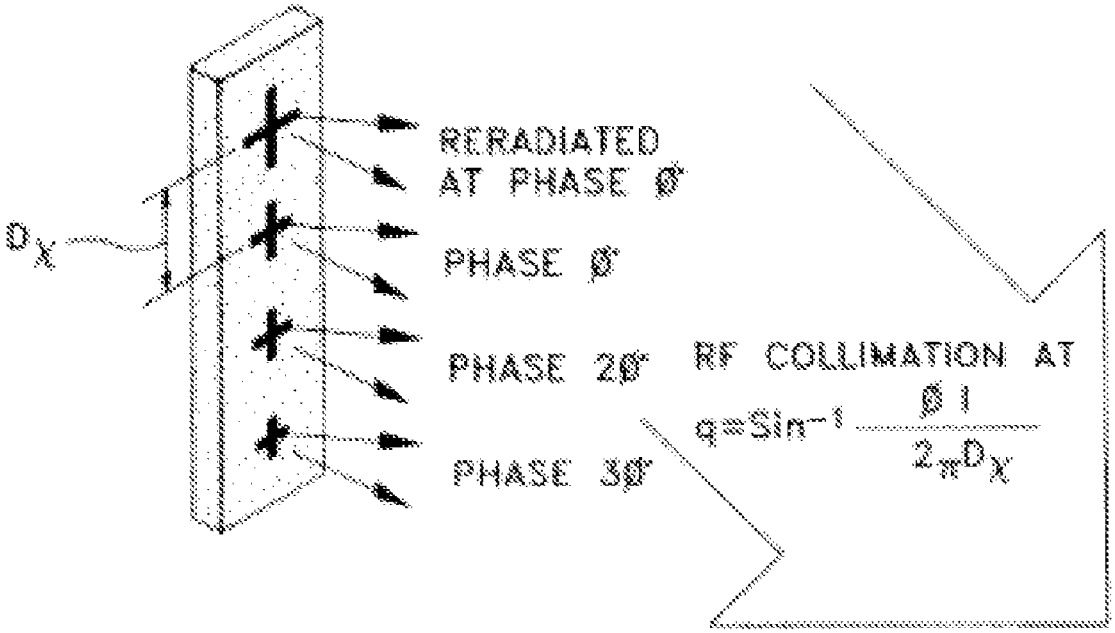
Figure 1B Prior Art
FIG. 1B is a perspective view of one form of a conventional phased array antenna (Prior Art).
Figure 1C:
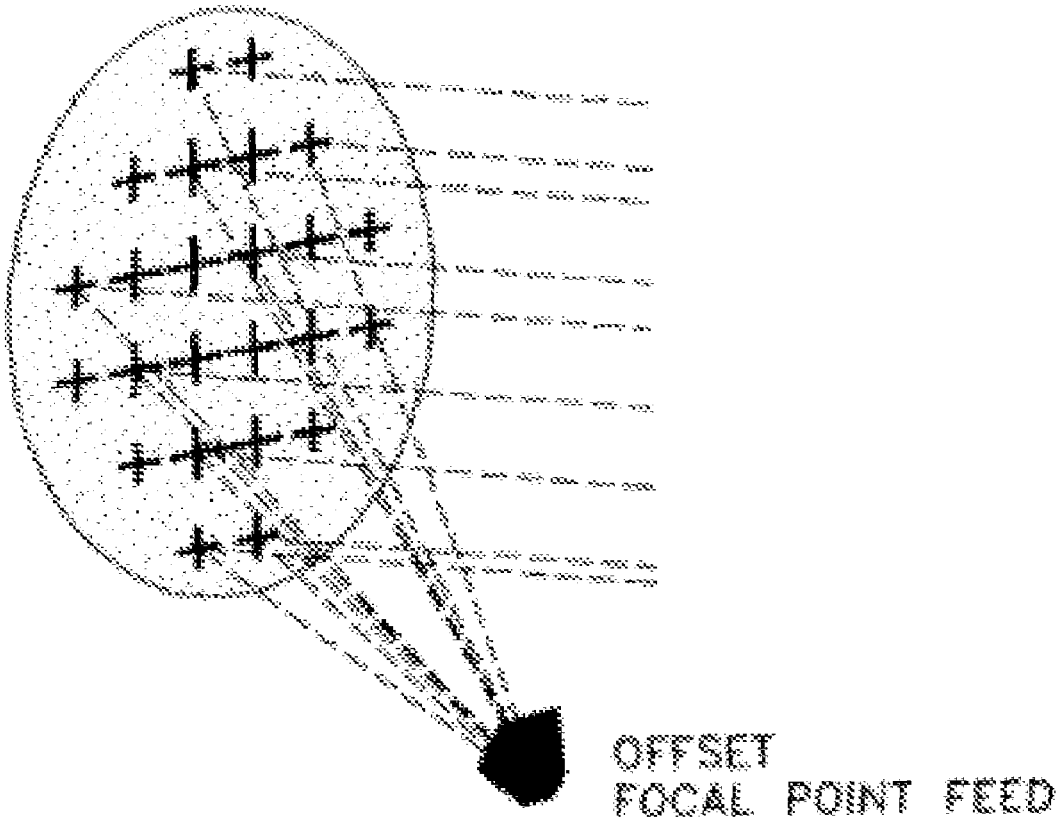
Figure 1C Prior Art
FIG. 1C is a perspective view of one form of a phased array antenna (Prior Art).
Figure 1D:
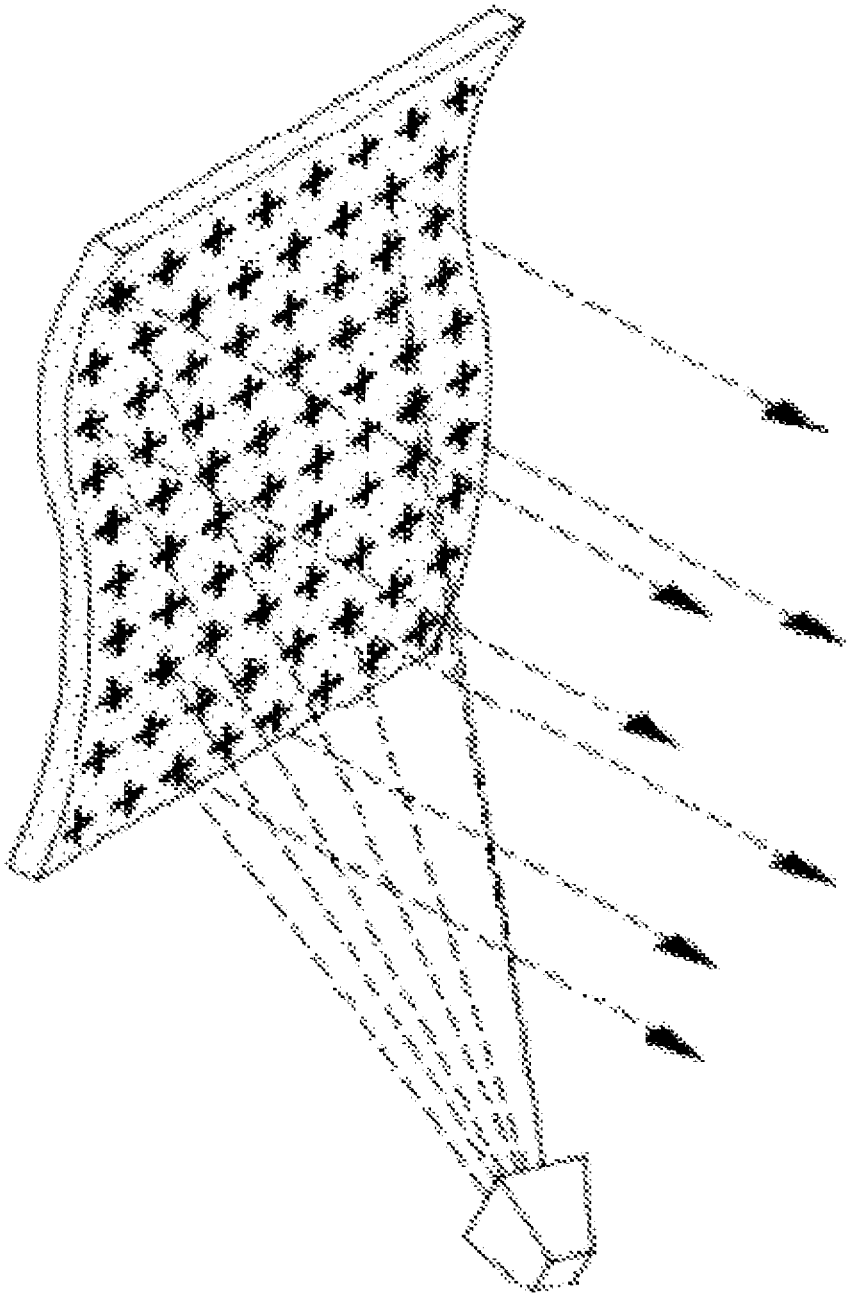
Figure 1D Prior Art
FIG. 1D is a perspective view of a conformal form of a phased array antenna (Prior Art).

FIG. 1A is an exemplary embodiment of an electromagnetically loading structure formed in accordance with the technology as disclosed in the prior art, for example Gonzalez et al. (014) and arrays thereof as shown in FIGS. 1B through 1D. The basic elemental structure, as shown in FIG. 1A, is a crossed shorted dipole situated over a ground plane with an intermediate dielectric material sandwiched there between. It is to be appreciated that each arm of the crossed dipole independently controls its corresponding polarization. Incident RF (radio frequency) energy causes a voltage standing wave to be set up between the dipole and the ground plane. The dipole itself possesses an RF reactance, which is a function of the size of the dipole. This combination of the formation of a voltage standing wave and the dipole reactance causes the incident RF energy to be reradiated with a phase shift $\phi$.

The exact value of this phase shift $\phi$ is a complex function of the dipole length and thickness, the distance between the dipole and the ground plane, the dielectric constant associated with the dielectric spacer and the angle associated with the incident RF energy. When used in an array, as shown in FIGS. 1B through 1D, the phase shift $\phi$ associated with a dipole is also affected by nearby dipoles.

In practice, the dipole arm lengths may be within the approximate range of one-quarter (¼) to one-sixteenth (1/16) of the wavelength of the operating frequency of the incident RF energy in order to provide a full range of phase shifts. The preferred spacing between a dipole and the ground plane is between approximately one-sixteenth (1/16) and one-eighth (⅛) of the wavelength associated with the incident RF energy wave. It is to be appreciated that the dipole/ground plane spacing also affects certain parameters of the phased array antenna, such as form factor, bandwidth and sensitivity to fabrication errors. The dipole structure in FIG. 1A is typically formed by the etching of a printed circuit board. At longer wavelengths (i.e., lower incident RF energy operating frequencies), plating of a dielectric fiber strand is an alternate dipole fabrication method. It is to be appreciated that a radiating element formed in accordance with this technology may operate at frequencies in the microwave and millimeter wave range.

As shown in FIG. 1B, each radiating element functions in a similar manner as a static phase shifter in a phased array antenna. Specifically, if a plurality of such radiating elements are designed to reradiate incident RF energy with a progressive series of phase shift $\phi$, $2\phi$, $3\phi$ . . . $n\phi$, then a resultant RF beam is formed in the direction $\theta$, which may be represented as:

$$\theta = \sin - 1\frac{\phi\lambda}{2\pi d_x}L \qquad \text{Eq. (1)}$$

Where $d_x$ represents the spacing between radiating elements, $\lambda$ represents the wavelength of the incident RF energy and Ø represents the element-to-element phase shift, i.e., the phase gradient.

Equation (1) is for beam steering in a single plane. Just as in two-dimensional phased array antennas, beam steering can be accomplished in both azimuth and elevation by application of phase gradients among the dipole radiating elements in both the x and y planes. In such case, the beam scan equation is dependent upon both the x and y spacing of the elements. It is to be appreciated that while the angle $\theta$ is referred to as the scan angle, the phased array formed by the radiating elements described in Gonzalez et al. (014) performs beam steering and focusing only, that is, the incident RF energy is reradiated in a single direction $\theta$, depending on the formation of the radiating elements, and does not perform an electronic scanning function.

While the embodiment illustrated in FIG. 1A shows a zero degree angle of incident RF energy, the incident RF wave may, in fact, be at any angle up to approximately 70 degrees. When such is the case, the angle of scattered energy, $\theta$, may be more generally represented as:

$$\theta = \sin^{-1}\frac{\phi\lambda}{2\pi d_x} - \sin\theta_0$$

where $\theta_o$ is the angle of incidence and $\theta$ is the beam energy scattering angle. Note that if:

$$\phi = \frac{4\pi d_x \sin\theta_0}{\lambda}$$

then the RF energy is returned in the direction from which it came even though the surface containing the radiating elements is at a tilted angle.

The phased array described in the context of FIG. 1B is considered to perform uniform radiation beam steering. However, this concept may be extended to the situation in which either the steering angle $\theta$ or the angle of incidence $\theta_o$, or both, are adjusted over the surface of the phased array of radiating elements. Such an approach, which utilizes a flat collimating surface, is illustrated in FIG. 1C. In the approach shown in FIG. 1C, the steering angle developed by the phase shifts of each radiating element is set in order to cause all incident energy to be focused on a feed. In this manner, the phased array functions as a parabolic reflector, but in a flat surface configuration. As shown in FIG. 1C, the RF energy is both focused and steered toward an offset feed. Using the above described local steering properties further allows the surface to be conformed to any reasonably smooth shape. Such a conformal phased array is illustrated in FIG. 1D.

While the above described phased array antennas technology disclosed in Gonzalez et al. (014) permit emulation of reflective surfaces and focusing elements of selected geometry, the individual radiating elements, e.g., dipoles, cannot be dynamically reconfigured. Due to the lack of dynamic reconfigurability of the dipoles, the above described phased array antennas are incapable of dynamically varying the phase shifts associated with the dipoles and, therefore, such antennas cannot perform electronic scanning functions.

Dynamically Reconfigured Phased Array Antennas Using Gas Plasma Technology

Dynamically reconfigurable antennas are known in the prior art. U.S. Pat. No. 5,864,322 (Pollon et al.) is an example of a dynamically reconfigurable phased array antenna using gas plasma.

Pollon (322 et al.) incorporates plasma technology whereby the radiating elements, e.g., dipoles, are dynamically configured (and reconfigured) such that the antenna may advantageously perform electronic scanning functions. The electronic scan antenna of the present invention includes at least one plasma structure. In one embodiment, the plasma structure has an electrode matrix formed by the intersection of one or a plurality of parallel vertical wire electrodes and one or a plurality of parallel horizontal wire electrodes. The vertical and horizontal electrodes are preferably orthogonal to each other and are electrically isolated from each other. Each intersection of a vertical and horizontal electrode defines a pixel. Each pixel may be defined by a unique (x,y) coordinate. A noble gas mixture (e.g., neon and xenon) is contained within the structure and in electrical communication with the electrode matrix. The electronic scan antenna also preferably includes control circuitry for controlling the activation of each pixel. Further, the electronic scan antenna of the present invention includes reflective means, e.g., a metal ground plane, for reflecting incident RF energy waves in the operating frequency range.

In Pollon et al. (322), different pixels may be excited by the control circuitry such that the plasma contained within the vicinity of the pixel becomes substantially RF conductive and thus, advantageously behaves like a reflecting element. Various pixels may be simultaneously excited in order to form reflecting elements having a variety of shapes and sizes. For example, gas-containing areas may be excited to form ionized plasma areas, which, in turn, form reflecting elements in the shape of dipoles. Accordingly, each plasma-reflecting element, in cooperation with the ground plane, reflects a portion of an incident RF wave and imparts a phase shift on the reflected wave causing the reflected wave to radiate in a direction $\theta$.

As previously mentioned, the adjustment of certain parameters associated with a dipole, e.g., length of dipole, affect the nature of the phase shift imparted. However, with respect to the prior art approach taught in Gonzalez et al. (014), once a dipole is etched into a printed circuit board, the parameters of the dipole such as dipole length cannot be dynamically changed. Thus, the phase shift imparted by the particular dipole is fixed, i.e., cannot be dynamically varied.

Because individual pixels may be selectively excited, the parameters associated with the radiating elements formed therewith may be advantageously reconfigured in a dynamic manner. In this way, the phase shift imparted by any particular dipole may be dynamically varied by varying the length, for example, of the dipole formed by the pixels of the plasma structure. Thus, a phased array antenna capable of radiating an electronically scanned RF beam may be formed by coordinating the dynamic variation of the parameters of each dipole (e.g., length).

The plasma technology provides a unique phasing structure for electromagnetically emulating a desired reflective surface of selected geometry over at least one operating frequency band. Such a novel phasing structure includes reflective means (i.e., ground plane) for reflecting energy of an incident RF beam within the at least one frequency band. The phasing structure also includes a phasing arrangement of at least one plasma structure which is operatively coupled to the reflective means whereby the plasma structure includes at least one gas containing area (i.e., the area in the immediate vicinity of a pixel) which is reflective at the one operating frequency range when ionized. Such a gas containing area forms an ionized plasma area, which is disposed a distance from the reflective means and has a particular size associated therewith. In this manner, the phasing structure generates a reflected RF beam with a phase shift imparted thereon, in response to the incident RF beam, so as to provide the emulation of the desired reflective surface of selected geometry. Preferably, the phasing structure further includes a control circuit for dynamically varying the size of the at least one ionized plasma area so that the phase shift imparted on the reflected RF beam dynamically varies so that the reflected RF beam is electronically scanned.

Figure 2A:
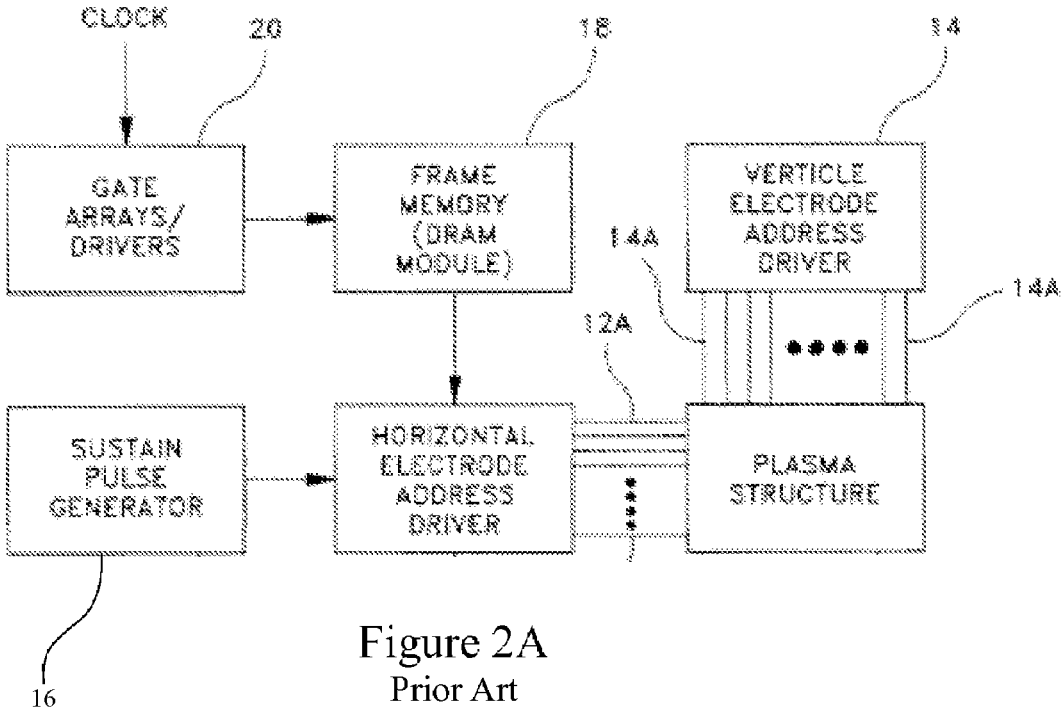
Figure 2A Prior Art
FIG. 2A is a block diagram example of a circuit for controlling a plasma structure as disclosed by U.S. Pat. No. 5,864,322 (Pollon et al.).
Figure 2B:
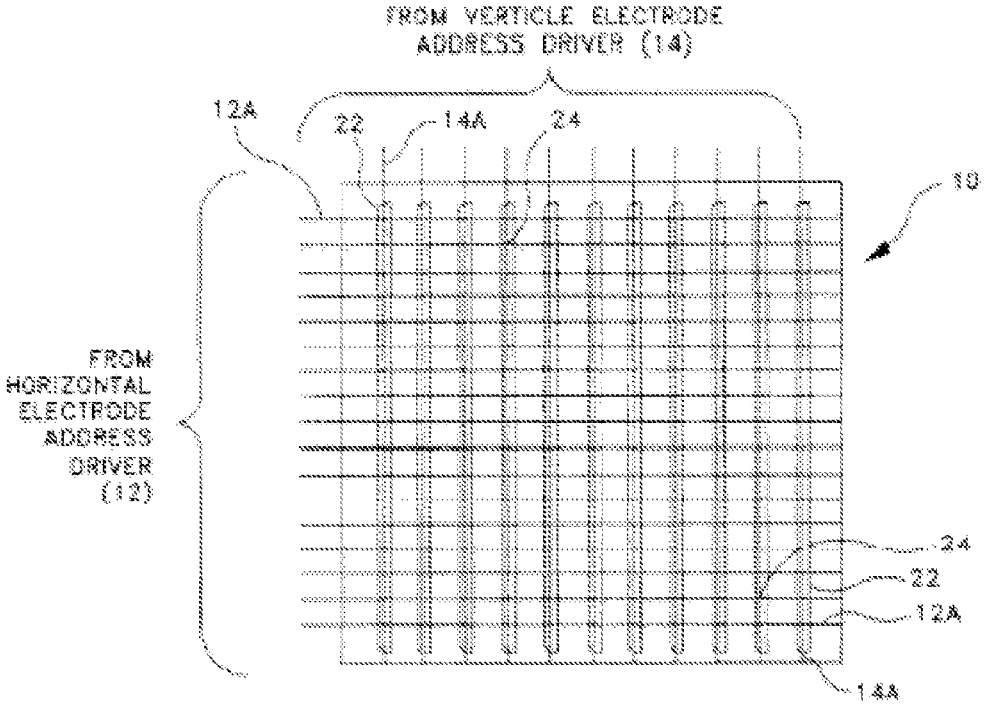
Figure 2B Prior Art
FIG. 2B is a cross sectional view of an example of a plasma display as disclosed by Pollon et al. (322).

FIGS. 2A and 2B are prior art diagrams of plasma displays used in the practice of the Pollon et al. (322) Dynamically Reconfigured Phased Array Antennas Using Gas Plasma Technology. They are described by Pollon et al. as follows:

A plasma structure 10 is respectively operatively coupled to a horizontal electrode address driver 12 and a vertical electrode address driver 14. Specifically, the horizontal electrode address driver 12 is operatively coupled to the plurality of horizontal electrodes 12A which run, in parallel, through the plasma structure 10, while the vertical electrode address driver 14 is operatively coupled to the plurality of vertical electrodes 14A which also run, in parallel, through the plasma structure 10. The horizontal and vertical electrodes are orthogonal (90 degrees offset from one another) and electrically isolated with respect to one another, and form the electrode matrix (or grid) previously discussed. The horizontal electrode address driver 12 is operatively coupled to a frame memory (DRAM module) 18, which may be controlled via a computer (not shown) through gate/array drivers 20. The vertical electrode address driver 14 may also be controlled through the computer (not shown). Typically, when the pixels (intersections of the horizontal and vertical electrodes) of the plasma structure 10 are to be addressed and thus activated (i.e., create voltage potential between intersecting electrodes), the vertical electrodes are selectively energized (i.e., voltage applied thereto) and the particular horizontal electrodes are selectively energized based on data stored in the frame memory 18. In this manner, the particular pixels of interest are activated, that is, the gas in the vicinity of the pixel is ionized. As previously mentioned, although plasma structure 10 has a latching feature, a pulse generator 16 may be provided to sustain the activation of the pixels, that is, provide a voltage potential (typically less than the initial excitation voltage potential) so that the gas associated with the pixel remains ionized and, thus, RF conductive.

Electron Density of a Plasma Display

Pollon et al. (322) discloses a conventional plasma display in FIG. 2B that illustrates an example of a plasma structure formed by a pair of glass plates with electrodes, 12A and 14A, and a noble gas (e.g., neon, xenon, and argon etc.) sandwiched in-between.

A key factor in the proper operation of dynamically reconfigured phased array antennas using gas plasma technology is the control of the electron density.

Pollon et al. (322) discloses at column 6, lines 30 et seq:

Furthermore, one of the features of plasma displays which is important to the operation of the present invention is that the electron density generated (e.g., NE=$10^{12}$ to $10^{14}$ electrons per $cm^3$) by the excited gases is sufficiently large to exhibit a plasma frequency which yields a highly RF conductive structure over the frequency range of approximately 1 GHz to 100 GHz. Also, another advantageous feature of the plasma element is that once fired (i.e., the gas is ionized), the element stays on (i.e., continues to conduct) even after removal of the firing voltage pulse (nonetheless, a sustaining voltage is typically uniformly applied to the activated pixel). The element is turned off (i.e., ceases to conduct) by application of a reverse voltage potential. Other methods of selectively exciting the gas may include pulsed signal excitation. It is to be appreciated that the latching property of the plasma elements, operating much like a core memory, is significant in simplifying the control circuitry employed for driving the plasma display, even for large antenna arrays, e.g., 108 element array antenna, formed in accordance with the present invention.

Figure 3A:
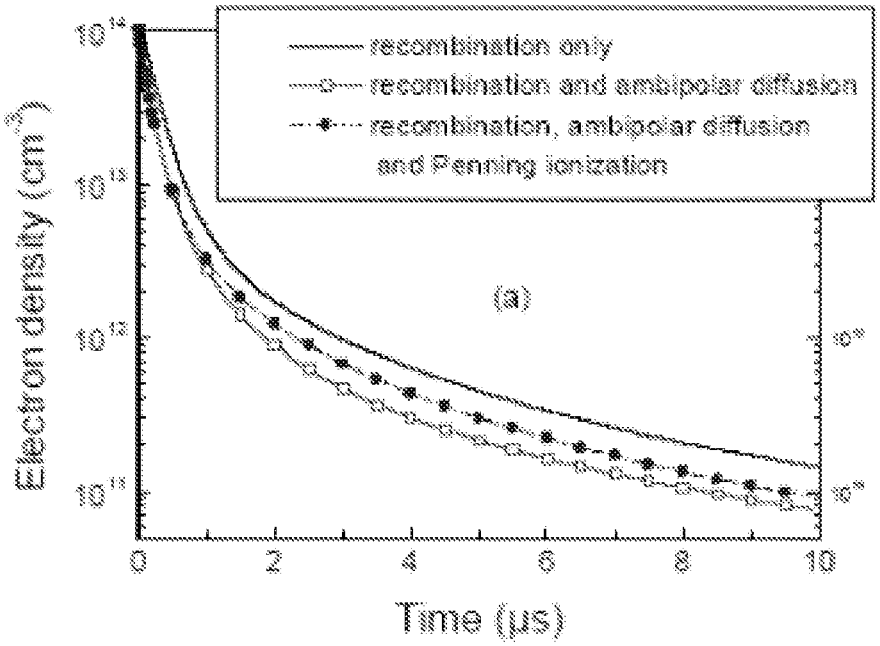
FIG. 3A is a graph of Electron density vs. Time in a plasma display (microsecond scale).
Figure 3B:
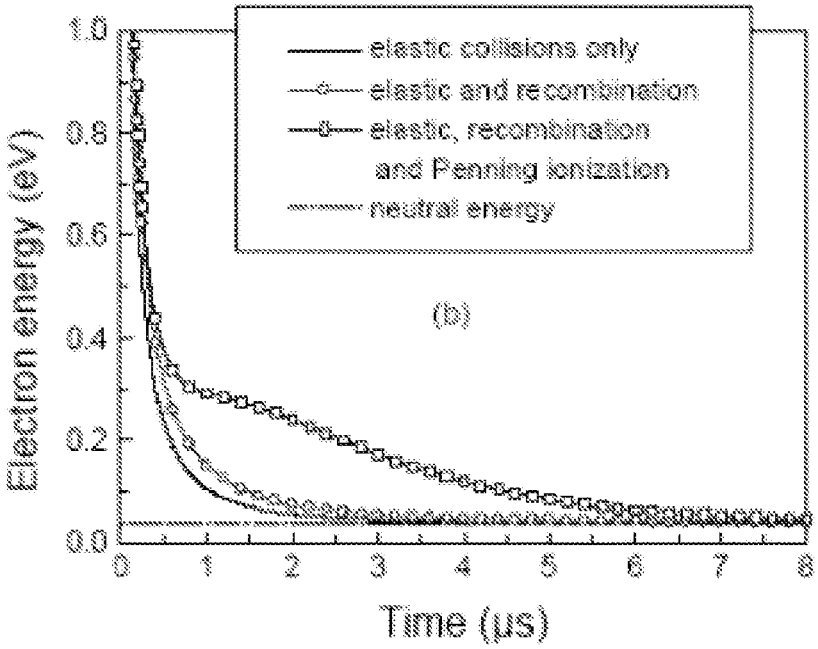
FIG. 3B is a graph of Electron energy vs. Time in a plasma display (microsecond scale).
Figure 3C:
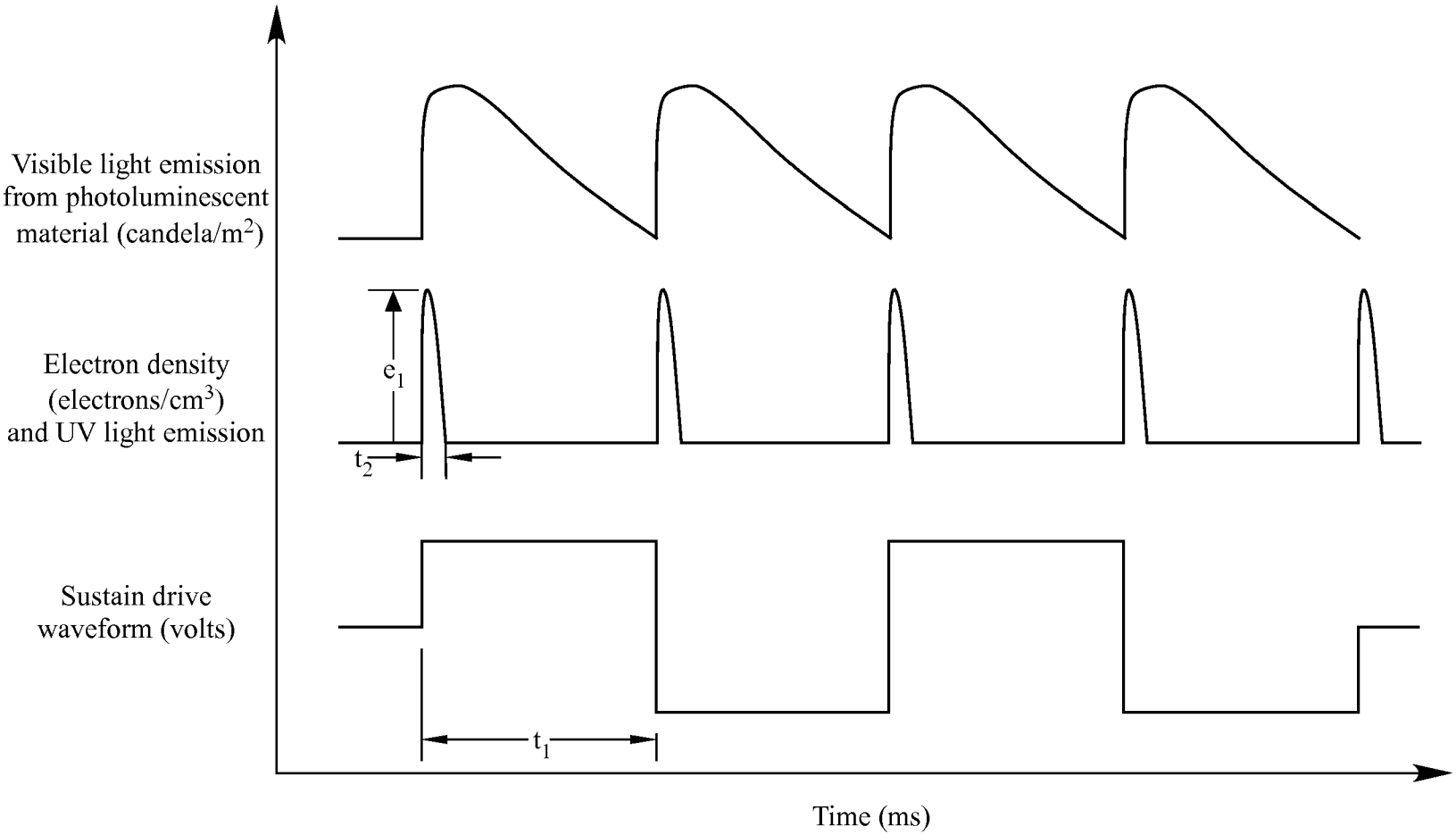
FIG. 3C is a discharge Electron density graph vs. Time diagram (millisecond scale).

Although a sustain voltage is sufficient to maintain the firing of the plasma, the electron density is not uniform. FIGS. 3A, 3B, and 3C show the electron density fluctuates by several orders of magnitude in several microseconds. Further, the electron energy also decays very rapidly within 100 ns. This fluctuation will not allow accurate dynamic control of the antenna.

FIG. 3C is a discharge electron density graph-timing diagram showing the timing relationships of a typical plasma display panel. Each plasma display pixel acts as a capacitor producing a brief intense discharge (with an electron density of $10^{14}$ $cm^3$) nominally on the order of 200 nanoseconds ($t_2$) with every sustain cycle. PDP sustain cycles occur nominally and are produced every 6000 nanoseconds; meaning that while the discharge appears to be continuous (i.e., the phosphor may decay over the sustain cycle time); the electron density that effects the RF phase delay (through reflection and/or refractive interaction with the RF wave) is not present. Operation in a radar environment requires a continuous electron density on the order of $10^{14}$ $cm^3$ to function in both transmit and receive modes. Consequently, the conventional PDP panels will not support radar phase delay operation.

In order to overcome the limitations imposed by the very short duration of the high electron density pulse (200 nanoseconds) a PDP, according to the present invention, uses a radio frequency (RF) voltage signal of one to several hundred MHz to cause a display discharge, i.e., a sustain discharge. In this case, since electrons perform a vibration motion (or a swing motion), the PDP maintains a display discharge while the radio frequency voltage signal is applied. In detail, if the radio frequency voltage signal, having alternating voltage polarities, is applied to any one of two electrodes opposed to each other, charged particles move toward one electrode or another electrode according to the polarity of the radio frequency voltage signal. Furthermore, the polarity of the radio frequency voltage signal is already inverted before a charged particle, in the discharge space moving toward the one of the electrodes, actually arrives at the electrode. The voltage inversion reverses the attractive force and direction of travel on the particle to the opposite electrode, before it is terminated at the first electrode. The process is repeated for each radio frequency cycle maintaining the oscillation pattern of the charged particles, and maintaining a constant high electron density within the discharge space. The charged particle in the discharging space swings between the two electrodes because the polarity of the radio frequency voltage signal is changed before the charged particle has arrived at any one of two electrodes. Therefore, during the supplying period of the radio frequency voltage signal, the charged particles do not extinguish and the excitation and transition of gaseous particles is continuously generated. Since the display discharge is maintained during a greater part of a set discharge period, the PDP, according to the present invention, enhances the discharging efficiency. Furthermore, the PDP increasingly enhances the discharging efficiency as well as energy efficiency because the radio frequency discharge has physical characteristics equal to the positive column of the glow discharge. As a result, the PDP, according to the present invention, can obtain a sufficient brightness with low power. Radio frequency voltage signal augmentation for plasma display panels are described in U.S. Pat. Nos. 6,624,799 (Kang et al.), 6,661,394 (Choi), 6,605,897 (Yoo), 6,501,447 (Kang et al.), 6,483,489 (Yoo et al.), 6,476,562 (Yoo et al.), 6,473,061 (Lim et al.), 6,340,866 (Yoo), 6,271,810 (Yoo et al.), and 6,794,820 (Kang et al.), all listed above and incorporated herein by reference.

Figure 4:
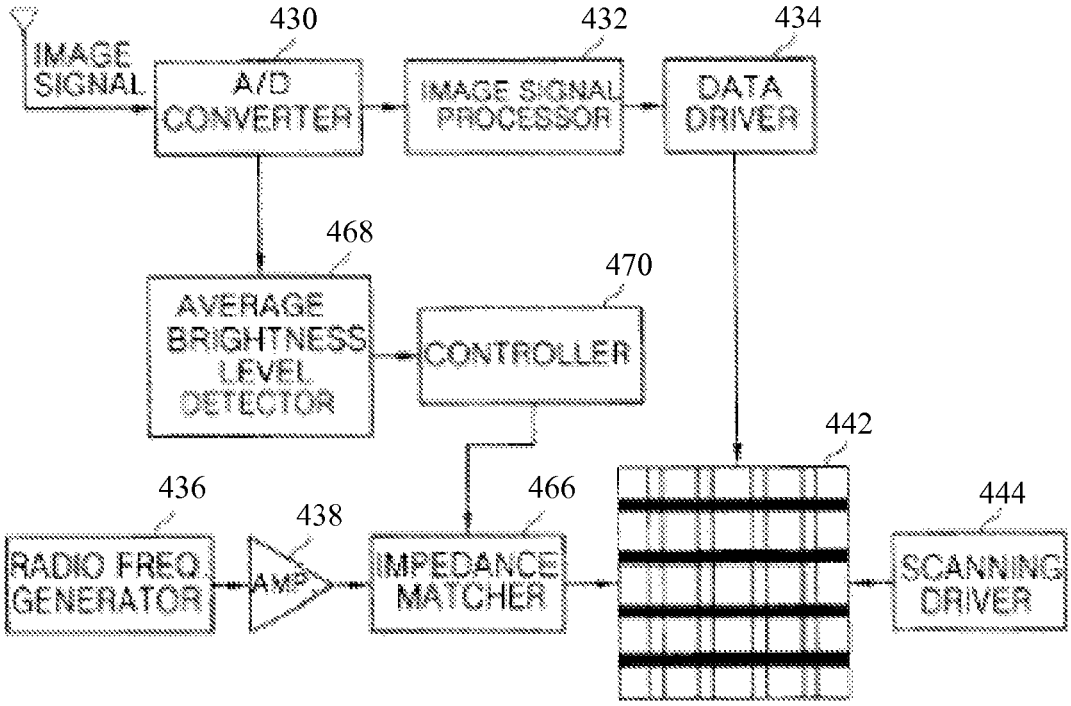
FIG. 4 is a block diagram of drive electronics for a plasma display with supplemental RF excitation.

FIG. 4 is an example of an electronic system that will produce an RF frequency such that a uniform electron density is maintained. FIG. 4 differs from FIG. 2A in that it has a dynamic impedance matching device 466 to support the varying load experienced by the RF amplifier 438.

FIG. 4 includes an A/D converter 430 for converting an input analog signal into a digital signal, an image signal processor 432 for converting the digital signal from the A/D converter 430 into a bit data and re-arranging the bit data, a data driver 434 for outputting a driving signal according to the data signal input from the image signal processor 432 to the panel 442, a radio frequency generator 436 for generating a radio frequency signal, a radio frequency amplifier 438 for amplifying and outputting the radio frequency signal from the radio frequency generator 436, an impedance matcher 466 for matching impedance between the radio frequency amplifier 38 and the panel 442, a scanning driver 444 for driving scanning electrode lines of the panel 442, an average brightness level detector 468 for detecting a brightness average value using the digital signal from the A/D converter 430, and a controller 470 for controlling a matching value of the impedance matcher 466 in accordance with an average value of the average brightness level detector 468. The A/D converter 430 converts an input analog image signal into a digital signal and outputs the digital signal. The image signal processor 432 converts the digital signal from the A/D converter 430 into a bit signal to rearrange and output the bit signal in compliance with a driving of the panel 442. The data driver 434 applies a driving signal according to an image data input from the image signal processor 432 to data electrode lines of the panel 442. The scanning driver 444 applies a scanning signal to scanning electrode lines of the panel 442. The radio frequency amplifier 438 amplifies a radio frequency signal generated from the radio frequency generator 436 into enough a power to cause a radio frequency discharge and outputs the same to the impedance matcher 466. The impedance matcher 466 differentiates an impedance matching value under control of the controller 470 to match impedance between the amplifier 438 and the panel 442, thereby applying a maximum power of radio frequency signal to radio frequency electrode lines of the panel. The average brightness level detector 468 averages a digital signal input from the A/D converter 430 for each field or frame to detect an average brightness level. The controller 470 controls a matching value of the impedance matcher 466 in correspondence with the average brightness level from the average brightness level detector 468.

The PDP, using the radio frequency discharge, must have at least one electrode for applying the radio frequency voltage signal to the discharging space injected with gases. Also, the PDP must include a plurality of plasma display cells each having discharging space in order to generate a pattern. An improvement on the prior art is a plasma display configuration making use of a flexible substrate employing encapsulating Plasma-tubes to contain the gas.

Figure 5:
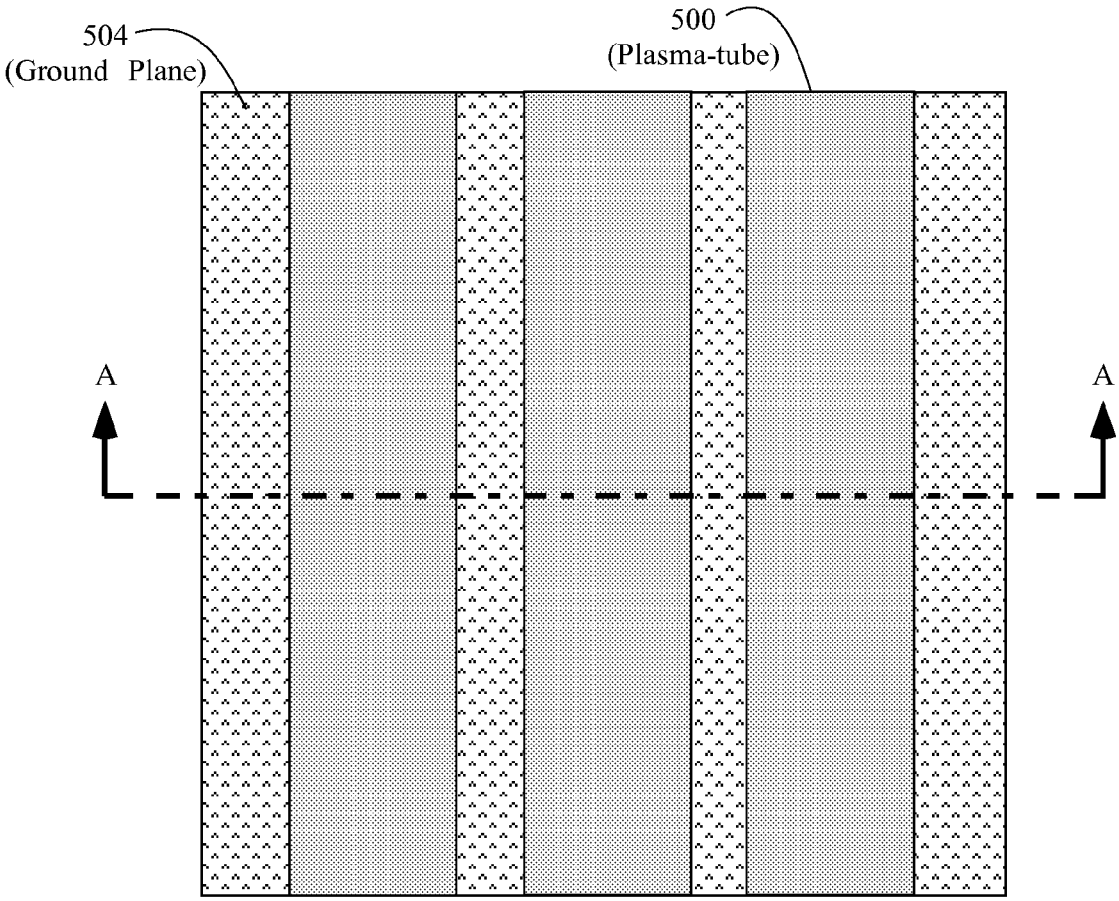
FIG. 5 is a top view of a Plasma-tube antenna with a ground plane above the column data and row scan electrodes.

FIG. 5 is a top view of a Plasma-tube antenna with a ground plane 504 with two electrodes per Plasma-tube with column data, row scan, and RF frequency excitation. The RF frequency can effectively increase the frequency of the waveform pattern of pulses so as to create a uniformly high-density electron plasma field as required for radar operation. In this embodiment Plasma-tubes 500 are attached to substrate 501, not shown, that contains column data/RF return electrodes 503, not shown, and row scan/RF supply electrodes 502, not shown.

Figure 5A:
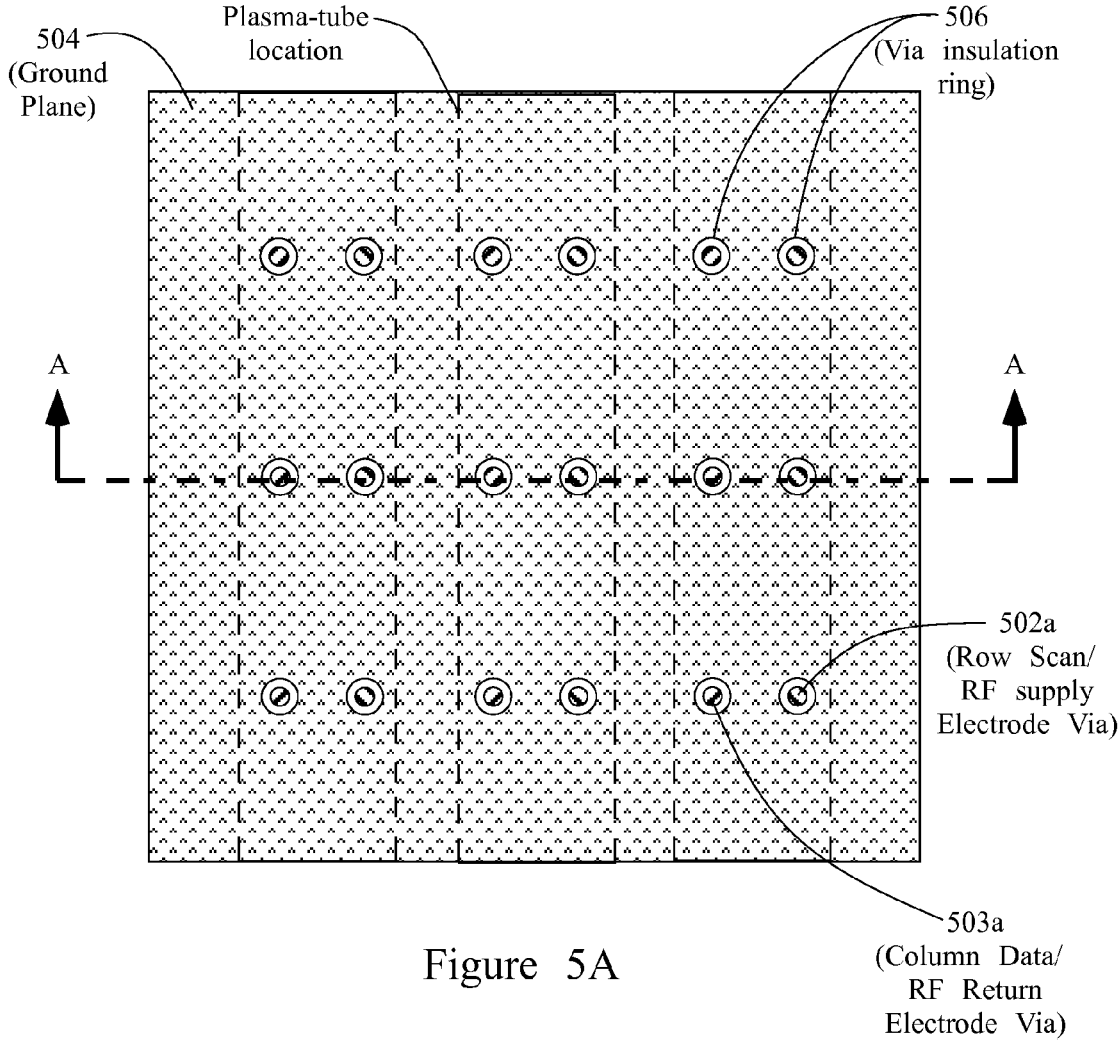
FIG. 5A is a top view of the substrate electrode vias in FIG. 5 shown with Plasma-tubes removed.

FIG. 5A is a top view of the substrate 501, not shown, showing ground plane 504, column data/RF return via/contacts 503*a*, row scan/RF supply via/contacts 502*a* and via insulating ring 506. Plasma-tubes are removed, however the mounting positions of Plasma-tubes are indicated by dashed lines.

Figure 5B:
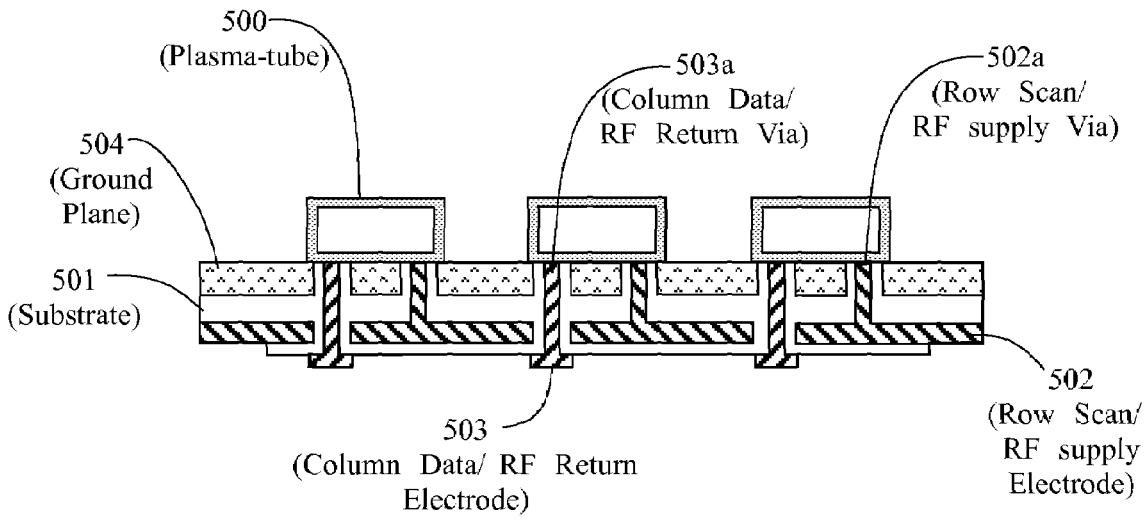
FIG. 5B is a section A-A view of the Plasma-tube antenna in FIG. 5.

FIG. 5B is a section view of the Plasma-tube antenna in FIG. 5. Plasma-tubes 500 are attached to substrate 501 making connection to column data/RF return electrode via 503*a* and row scan/RF supply electrode via 502*a*. Column data/RF return electrodes 503 and row scan/RF supply electrodes 502 supply signals to electrode via connective members. Also shown is the ground plane 504.

Figure 6:
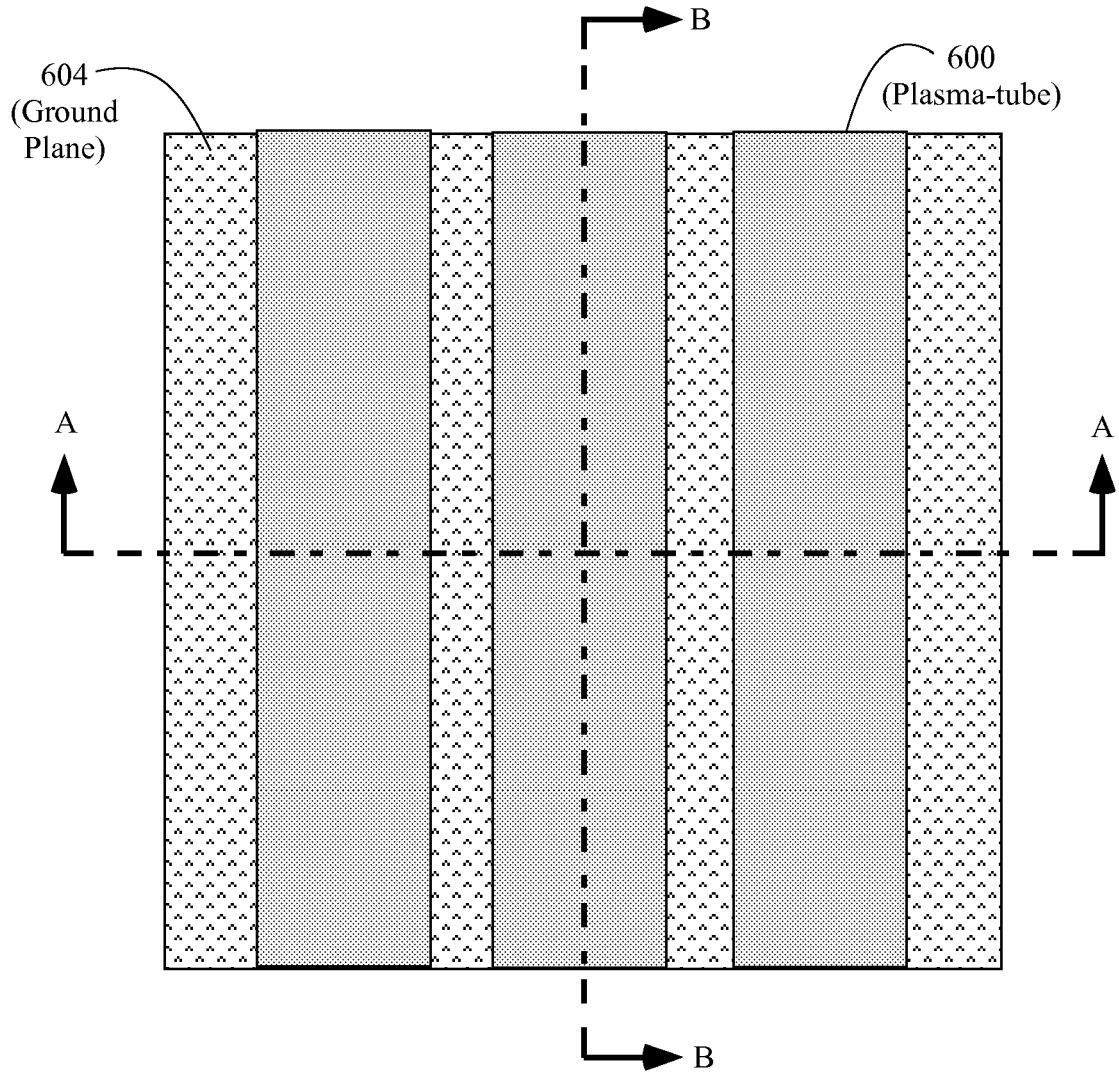
FIG. 6 is a top view of a Plasma-tube antenna including added electrodes with supplemental RF excitation.

FIG. 6 is a top view of a Plasma-tube antenna with a top ground plane 604 with two added electrodes RF supply electrode #1 and RF supply electrode #2 to provide supplemental plasma excitation with RF energy to Plasma-tube 600. One or more RF supply electrodes may be provided. The RF supply can effectively enhance the waveform pattern of pulses so as to create a uniformly high-density electron plasma field as required for radar operation.

Figure 6A:
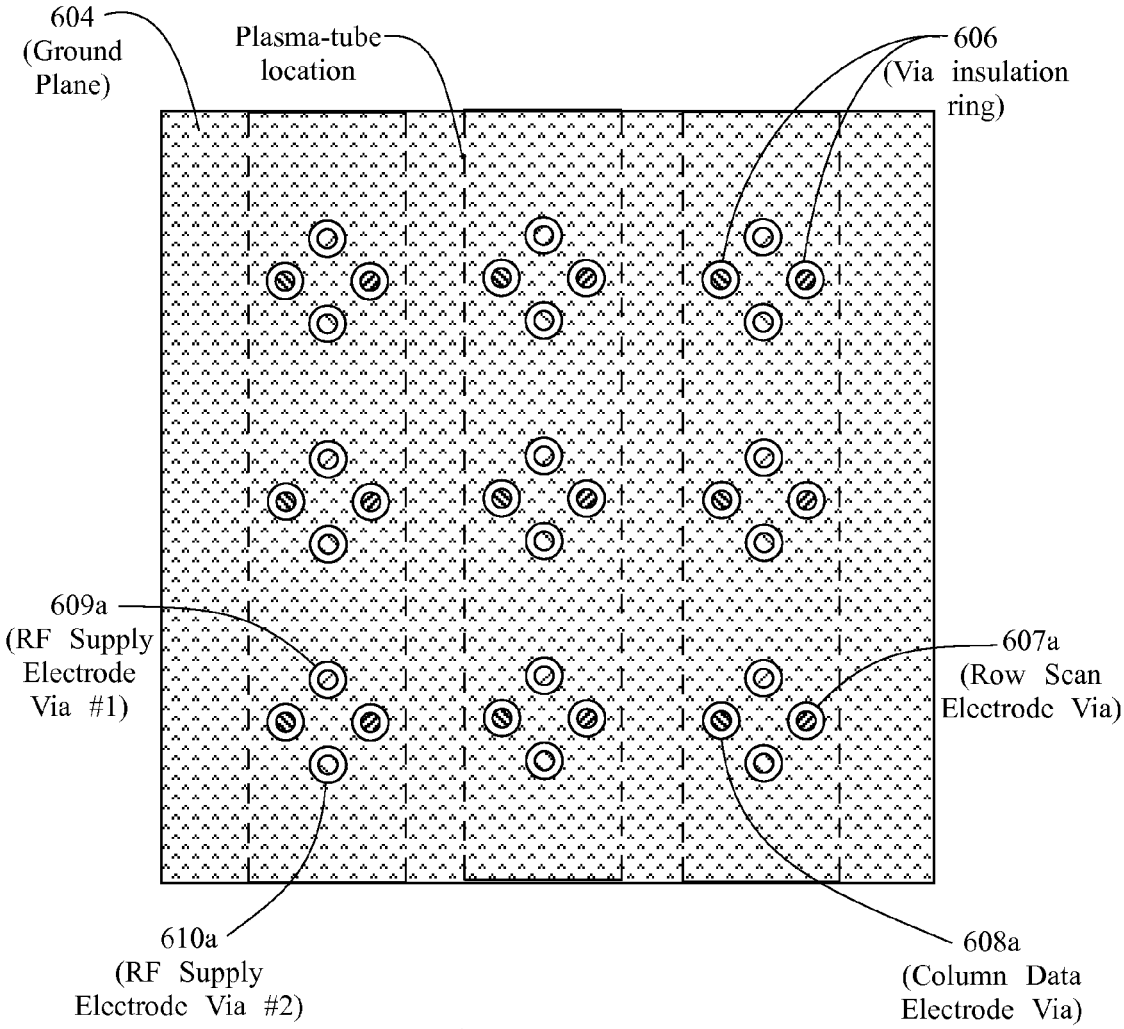
FIG. 6A is a top view of the Plasma-tube substrate electrode vias in FIG. 6 shown with Plasma-tubes removed.

FIG. 6A is a top view of Plasma-tube antenna in FIG. 6 showing ground plane 604, column data electrode via 608*a*, row scan electrode via 607*a*, RF supply electrode #1 via 609*a*, and RF supply electrode #2 via 610*a* isolated by insulation rings 606. Plasma-tubes are removed in this view, with the mounting positions of Plasma-tubes indicated by dashed lines.

Figure 6B:
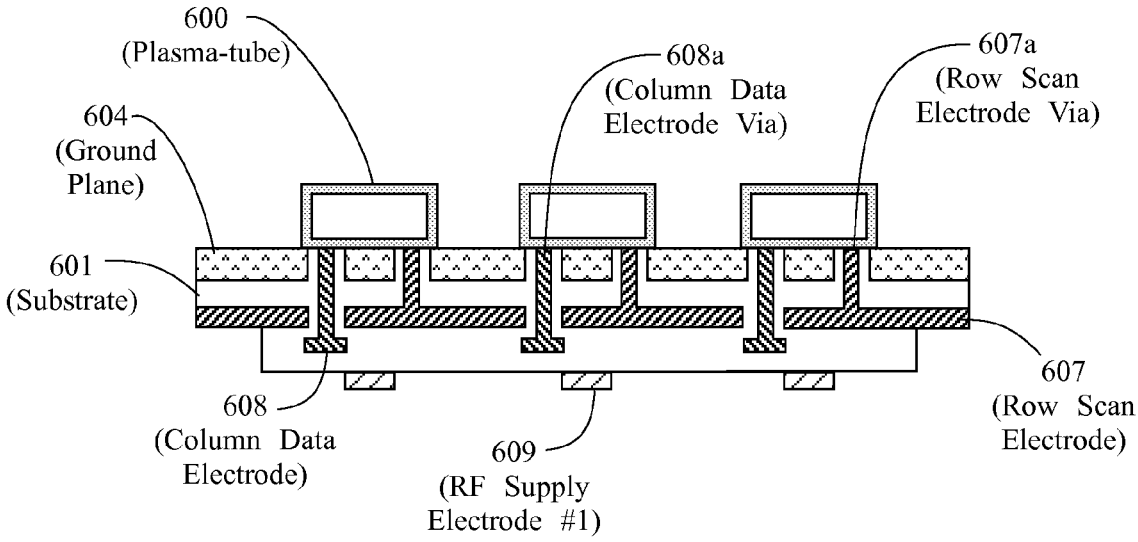
FIG. 6B is a section A-A view of a Plasma-tube antenna in FIG. 6.

FIG. 6B is a section view A-A of the Plasma-tube antenna in FIG. 6, showing Plasma-tubes 600 attached to substrate 601 with connection to column data electrode vias 608*a*, and row scan electrode vias 607*a* making contact to Plasma-tubes though ground plane 604. Column data electrodes 608 and row scan electrodes 607 supply appropriate waveforms to electrode vias. RF supply electrode 609 and RF return electrodes 610 are visible in FIG. 6C, only a portion of RF supply electrode is visible in this view.

Figure 6C:
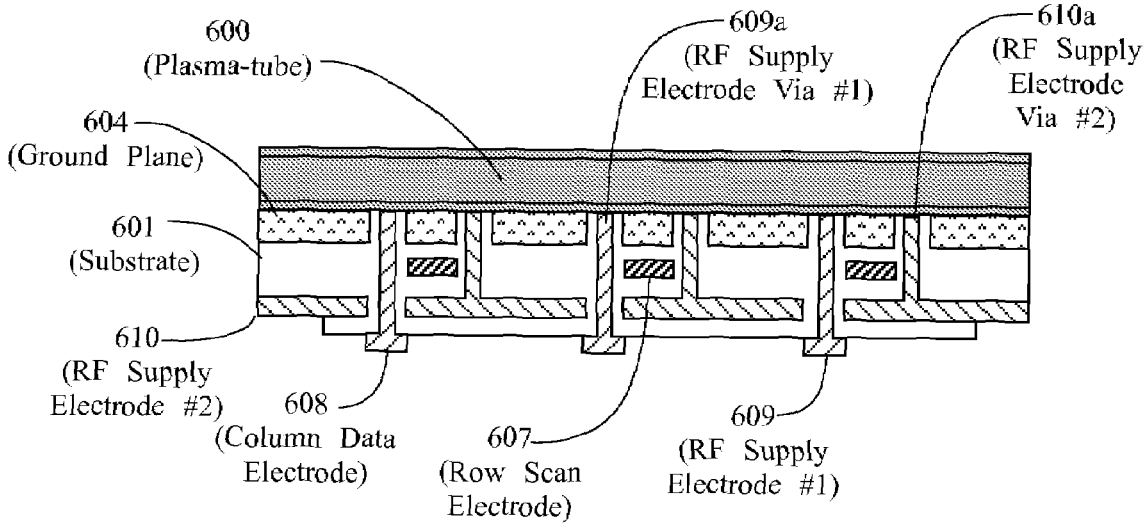
FIG. 6C is a second section B-B view of a Plasma-tube antenna in FIG. 6.

FIG. 6C is a section view B-B of the Plasma-tube antenna in FIG. 6, showing Plasma-tubes 600 attached to substrate 601 with connection to RF supply electrode #1 vias 609*a*, and RF return electrode #2 vias 610*a* making contact to Plasma-tubes though ground plane 604. RF supply electrodes #1 609 and RF supply electrodes #2 610 are connected to their respective RF electrode vias.

Plasma-tube Materials

The Plasma-tube may be constructed of any suitable material such as glass or plastic as disclosed in the prior art. The Plasma-tube material may be opaque, transparent, translucent, or non-light transmitting. In the practice of this invention, it is contemplated that the Plasma-tube may be made of any suitable inorganic compounds of metals and/or metalloids, including mixtures or combinations thereof. Contemplated inorganic compounds include the oxides, carbides, nitrides, nitrates, silicates, aluminates, phosphates, sulfides, sulfates, and/or borates.

The metals and/or metalloids are selected from magnesium, calcium, strontium, barium, yttrium, lanthanum, cerium, neodymium, gadolinium, terbium, erbium, thorium, titanium, zirconium, hafnium, vanadium, niobium, tantalum, chromium, molybdenum, tungsten, manganese, rhenium, iron, ruthenium, osmium, cobalt, rhodium, iridium, nickel, copper, silver, zinc, cadmium, boron, aluminum, gallium, indium, thallium, carbon, silicon, germanium, tin, lead, phosphorus, and bismuth.

Inorganic materials suitable for use are magnesium oxide (s), aluminum oxide(s), zirconium oxide(s), and silicon carbide(s) such as MgO, $Al_2O_3$, $ZrO_2$, $SiO_2$, and/or SiC.

In one embodiment of this invention, the Plasma-tube is made of fused particles of glass, ceramic, glass ceramic, refractory, fused silica, quartz, or like amorphous and/or crystalline materials including mixtures of such.

In one preferred embodiment, a ceramic material is selected based on its transmissivity to light after firing. This may include selecting ceramics material with various optical cutoff frequencies to produce various colors. One preferred material contemplated for this application is aluminum oxide.

Aluminum oxide is transmissive from the UV range to the IR range. Because it is transmissive in the UV range, phosphors excited by UV may be applied to the exterior of the Plasma-tube to produce various colors. The application of the phosphor to the exterior of the Plasma-tube may be done by any suitable means before or after the Plasma-tube is positioned in the PDP, i.e., on a flexible or rigid substrate. There may be applied several layers or coatings of phosphors, each of a different composition.

In one specific embodiment of this invention, the Plasma-tube is made of an aluminate silicate or contains a layer of aluminate silicate. When the ionizable gas mixture contains helium, the aluminate silicate is especially beneficial in preventing the escaping of helium.

It is also contemplated that the Plasma-tube may be made of lead silicates, lead phosphates, lead oxides, borosilicates, alkali silicates, aluminum oxides, and pure vitreous silica.

For secondary electron emission, the Plasma-tube may be made in whole or in part from one or more materials such as magnesium oxide having a sufficient Townsend coefficient. These include inorganic compounds of magnesium, calcium, strontium, barium, gallium, lead, aluminum, boron, and the rare earths especially lanthanum, cerium, actinium, and thorium. The contemplated inorganic compounds include oxides, carbides, nitrides, nitrates, silicates, aluminates, phosphates, borates, and other inorganic compounds of the above and other elements.

The Plasma-tube may also contain or be partially or wholly constructed of luminescent materials such as inorganic phosphor(s). The phosphor may be a continuous or discontinuous layer or coating on the interior or exterior of the tube. Phosphor particles may also be introduced inside the Plasma-tube or embedded within the tube. Luminescent quantum dots may also be incorporated into the tube.

Secondary Electron Emission

The use of secondary electron emission (Townsend coefficient) materials in a plasma display is well known in the prior art and is disclosed in U.S. Pat. No. 3,716,742 (Nakayama et al.). The use of Group IIA compounds including magnesium oxide is disclosed in U.S. Pat. Nos. 3,836,393 and 3,846,171. The use of rare earth compounds in an AC plasma display is disclosed in U.S. Pat. Nos. 4,126,807, 4,126,809, and 4,494,038, all issued to Wedding et al., and incorporated herein by reference. Lead oxide may also be used as a secondary electron material. Mixtures of secondary electron emission materials may be used.

In one embodiment and mode contemplated for the practice of this invention, the secondary electron emission material is magnesium oxide on part or all of the internal surface of a Plasma-tube. The secondary electron emission material may also be on the external surface. The thickness of the magnesium oxide may range from about 250 Angstrom Units (Å) to about 10,000 Angstrom Units (Å).

The entire Plasma-tube may be made of a secondary electronic material such as magnesium oxide. A secondary electron material may also be dispersed or suspended as particles within the ionizable gas such as with a fluidized bed. Phosphor particles may also be dispersed or suspended in the gas such as with a fluidized bed, and may also be added to the inner or external surface of the Plasma-tube.

Magnesium oxide increases the ionization level through secondary electron emission that in turn leads to reduced gas discharge voltages. In one embodiment, the magnesium oxide is on the inner surface of the Plasma-tube and the phosphor is located on external surface of the Plasma-tube.

Magnesium oxide is susceptible to contamination. To avoid contamination, gas discharge (plasma) displays are assembled in clean rooms that are expensive to construct and maintain. In traditional plasma panel production, magnesium oxide is applied to an entire open substrate surface and is vulnerable to contamination. The adding of the magnesium oxide layer to the inside of a Plasma-tube minimizes exposure of the magnesium oxide to contamination.

The magnesium oxide may be applied to the inside of the Plasma-tube by incorporating magnesium vapor as part of the ionizable gases introduced into the Plasma-tube while it is at an elevated temperature. The magnesium may be oxidized while at an elevated temperature.

In some embodiments, the magnesium oxide may be added as particles to the gas. Other secondary electron materials may be used in place of or in combination with magnesium oxide. In one embodiment hereof, the secondary electron material such as magnesium oxide or any other selected material such as magnesium to be oxidized in situ is introduced into the gas by means of a fluidized bed. Other materials such as phosphor particles or vapor may also be introduced into the gas with a fluid bed or other means.

Ionizable Gas

The hollow Plasma-tube as used in the practice of this invention contain(s) one or more ionizable gas components. In the practice of this invention, the gas is selected to emit photons in the visible, IR, and/or UV spectrum.

The UV spectrum is divided into regions. The near UV region is a spectrum ranging from about 340 to 450 nm (nanometers). The mid or deep UV region is a spectrum ranging from about 225 nm to 340 nm. The vacuum UV region is a spectrum ranging from about 100 nm to 225 nm. The PDP prior art has used vacuum UV to excite photoluminescent phosphors. In the practice of this invention, it is contemplated using a gas, which provides UV over the entire spectrum ranging from about 100 nm to about 450 nm. The PDP operates with greater efficiency at the higher range of the UV spectrum, such as in the mid UV and/or near UV spectrum. In one preferred embodiment, there is selected a gas which emits gas discharge photons in the near UV range. In another embodiment, there is selected a gas which emits gas discharge photons in the mid UV range. In one embodiment, the selected gas emits photons from the upper part of the mid UV range through the near UV range, about 275 nm to 450 nm.

As used herein, ionizable gas or gas means one or more gas components. In the practice of this invention, the gas is typically selected from a mixture of the noble or rare gases of neon, argon, xenon, krypton, helium, and/or radon. The rare gas may be a Penning gas mixture. Other contemplated gases include nitrogen, $CO_2$, CO, mercury, halogens, excimers, oxygen, hydrogen, and mixtures thereof.

Isotopes of the above and other gases are contemplated. These include isotopes of helium such as helium-3, isotopes of hydrogen such as deuterium (heavy hydrogen), tritium ($T^3$) and DT, isotopes of the rare gases such as xenon 129 and isotopes of oxygen such as oxygen-18. Other isotopes include deuterated gases such as deuterated ammonia ($ND_3$) and deuterated silane ($SiD_4$).

In one embodiment, a two-component gas mixture (or composition) is used such as a mixture of argon and xenon, argon and helium, xenon and helium, neon and argon, neon and xenon, neon and helium, and neon and krypton. Specific two-component gas mixtures (compositions) include about 5% to 90% atoms of argon with the balance xenon. Another two-component gas mixture is a mother gas of neon containing 0.05% to 15% atoms of xenon, argon, or krypton.

The gas mixture can also be a three-component gas, four-component gas, or five-component gas by using small quantities of an additional gas or gases selected from xenon, argon, krypton, and/or helium. In one embodiment, a three-component ionizable gas mixture is used such as a mixture of argon, xenon, and neon wherein the mixture contains at least 5% to 80% atoms of argon, up to 15% xenon, and the balance neon. The xenon is present in a minimum amount sufficient to maintain the Penning effect. Such a mixture is disclosed in U.S. Pat. No. 4,926,095 (Shinoda et al.), incorporated herein by reference. Other three-component gas mixtures include argon-helium-xenon; krypton-neon-xenon; and krypton-helium-xenon.

U.S. Pat. No. 4,081,712 (Bode et al.), incorporated by reference, discloses the addition of helium to a gaseous medium of 90% to 99.99% atoms of neon and 10% to 0.01% atoms of argon, xenon, and/or krypton.

In one embodiment there is used a high concentration of helium with the balance selected from one or more gases of neon, argon, xenon, and nitrogen as disclosed in U.S. Pat. No. 6,285,129 (Park), incorporated herein by reference.

A high concentration of xenon may also be used with one or more other gases as disclosed in U.S. Pat. No. 5,770,921 (Aoki et al.), incorporated herein by reference.

Pure neon may be used and the Plasma-tubes operated without memory margin using the architecture disclosed by U.S. Pat. No. 3,958,151 (Yano) discussed above and incorporated by reference.

Excimers

Excimer gases may also be used as disclosed in U.S. Pat. Nos. 4,549,109 ( Nighan et al.) and 4,703,229 (Nighan et al.), incorporated herein by reference. Nighan et al. (109) and (229) disclose the use of excimer gases formed by the combination of halogens with rare gases. The halogens include fluorine, chlorine, bromine, and iodine. The rare gases include helium, xenon, argon, neon, krypton, and radon. Excimer gases may emit red, blue, green, or other color light in the visible range or light in the invisible range. U.S. Pat. No. 6,628,088 (Kim et al.), incorporated herein by reference, also discloses excimer gases for a PDP.

Other Gases

A wide variety of other gases are contemplated for the practice of this invention. Such other gases include $C_2H_2$—$CF_4$—Ar mixtures as disclosed in U.S. Pat. Nos. 4,201,692 (Christophorou et al.) and 4,309,307 (Christophorou et al.), incorporated herein by reference. Also contemplated are gases disclosed in U.S. Pat. No. 4,553,062 (Ballon et al.), incorporated by reference. Other gases include sulfur hexafluoride, HF, $H_2S$, $SO_2$, SO, $H_2O_2$, and so forth.

Gas Pressure

This invention allows the construction and operation of a gas discharge (plasma) display with gas pressures at or above 1 atmosphere. In the prior art, gas discharge (plasma) displays are operated with the ionizable gas at a pressure below atmospheric. Gas pressures above atmospheric are not used in the prior art because of structural problems. Higher gas pressures above atmospheric may cause the display substrates to separate, especially at elevations of 4000 feet or more above sea level. Such separation may also occur between the substrate and a viewing envelope or dome in a single substrate or monolithic plasma panel structure.

In the practice of this invention, the gas pressure inside of the hollow Plasma-tube may be equal to or less than atmospheric pressure or may be equal to or greater than atmospheric pressure. The typical sub-atmospheric pressure is about 150 to 760 Torr. However, pressures above atmospheric may be used depending upon the structural integrity of the Plasma-tube.

In one embodiment of this invention, the gas pressure inside of the Plasma-tube is equal to or less than atmospheric, about 150 to 760 Torr, typically about 350 to about 650 Torr.

In another embodiment of this invention, the gas pressure inside of the Plasma-tube is equal to or greater than atmospheric. Depending upon the structural strength of the Plasma-tube, the pressure above atmospheric may be about 1 to 250 atmospheres (760 to 190,000 Torr) or greater. Higher gas pressures increase the luminous efficiency of the plasma display.

Gas Processing

This invention avoids the costly prior art gas filling techniques used in the manufacture of gas discharge (plasma) display devices. The prior art introduces gas through one or more apertures into the device requiring a gas injection hole and tube. The prior art manufacture steps typically include heating and baking out the assembled device (before gas fill) at a high-elevated temperature under vacuum for 2 to 12 hours. The vacuum is obtained via external suction through a tube inserted in an aperture.

The bake out is followed by back fill of the entire panel with an ionizable gas introduced through the tube and aperture. The tube is then sealed-off.

This bake out and gas fill process is a major production bottleneck and yield loss in the manufacture of gas discharge (plasma) display devices, requiring substantial capital equipment and a large amount of process time. For color AC plasma display panels of 40 to 50 inches in diameter, the bake out and vacuum cycle may be 10 to 30 hours per panel or 10 to 30 million hours per year for a manufacture facility producing over 1 million plasma display panels per year.

The gas-filled Plasma-tubes used in this invention can be produced in large economical volumes and added to the gas discharge (plasma) display device without the necessity of costly bake out and gas process capital equipment. The savings in capital equipment cost and operations costs are substantial. Also the entire PDP does not have to be gas processed with potential yield loss at the end of the PDP manufacture.

PDP Structure

In one embodiment, the Plasma-tubes are located on or in a single substrate or monolithic PDP structure. Single substrate PDP structures are disclosed in U.S. Pat. Nos. 3,646,384 (Lay), 3,652,891 (Janning), 3,666,981 (Lay), 3,811,061 (Nakayama et al.), 3,860,846 (Mayer), 3,885,195 (Amano), 3,935,494 (Dick et al.), 3,964,050 (Mayer), 4,106,009 (Dick), 4,164,678 (Biazzo et al.), and 4,638,218 (Shinoda), all cited above and incorporated herein by reference. The Plasma-tubes may be positioned on the surface of the substrate and/or positioned in the substrate such as in channels, trenches, grooves, wells, cavities, hollows, and so forth. These channels, trenches, grooves, wells, cavities, hollows, etc., may extend through the substrate so that the Plasma-tubes positioned therein may be viewed from either side of the substrate.

The Plasma-tubes may also be positioned on or in a substrate within a dual substrate plasma display structure. Each tube is placed inside of the gas discharge (plasma) display device, for example, on the substrate along the channels, trenches or grooves between the barrier walls of a plasma display barrier structure such as disclosed in U.S. Pat. Nos. 5,661,500 (Shinoda et al.), 5,674,553 (Shinoda et al.), and 5,793,158 (Wedding), cited above and incorporated herein by reference. The Plasma-tubes may also be positioned within a cavity, well, hollow, concavity, or saddle of a plasma display substrate, for example as disclosed by U.S. Pat. No. 4,827,186 (Knauer et al.), incorporated herein by reference.

In a device as disclosed by Wedding (158) or Shinoda et al. (500), the Plasma-tubes may be conveniently added to the substrate cavities and the space between opposing electrodes before the device is sealed. An aperture and tube can be used for bake out if needed of the space between the two opposing substrates, but the costly gas fill operation is eliminated.

AC plasma displays of 40 inches or larger are fragile with risk of breakage during shipment and handling. The presence of the Plasma-tubes inside of the display device adds structural support and integrity to the device.

The Plasma-tubes may be sprayed, stamped, pressed, poured, screen-printed, or otherwise applied to the substrate. The substrate surface may contain an adhesive or sticky surface to bind the Plasma-tube to the substrate.

The practice of this invention is not limited to a flat surface display. The Plasma-tube may be positioned or located on a conformal surface or substrate so as to conform to a predetermined shape such as a curved or irregular surface.

In one embodiment of this invention, each Plasma-tube is positioned within a cavity on a single-substrate or monolithic gas discharge structure that has a flexible or bendable substrate. In another embodiment, the substrate is rigid. The substrate may also be partially or semi-flexible.

Substrate

In accordance with various embodiments of this invention, the PDP may be comprised of a single substrate or dual substrate device with flexible, semi-flexible or rigid substrates. The substrate may be opaque, transparent, translucent, or non-light transmitting. In some embodiments, there may be used multiple substrates of three or more. Substrates may be flexible films, such as a polymeric film substrate. The flexible substrate may also be made of metallic materials alone or incorporated into a polymeric substrate. Alternatively or in addition, one or both substrates may be made of an optically transparent thermoplastic polymeric material. Examples of such materials are polycarbonate, polyvinyl chloride, polystyrene, polymethyl methacrylate, polyurethane polyimide, polyester, and cyclic polyolefin polymers. More broadly, the substrates may include a flexible plastic such as a material selected from the group consisting of polyether sulfone (PES), polyester terephihalate, polyethylene terephihalate (PET), polyethylene naphtholate, polycarbonate, polybutylene terephihalate, polyphenylene sulfide (PPS), polypropylene, polyester, aramid, polyamide-imide (PAI), polyimide, aromatic polyimides, polyetherimide, acrylonitrile butadiene styrene, and polyvinyl chloride, as disclosed in U.S. Patent Application Publication 2004/0179145 (Jacobsen et al.), incorporated herein by reference.

Alternatively, one or both of the substrates may be made of a rigid material. For example, one or both of the substrates may be a glass substrate. The glass may be a conventionally available glass, for example having a thickness of approximately 0.2 mm-1 mm. Alternatively, other suitable materials may be used, such as a rigid plastic or a plastic film.

Further details regarding substrates and substrate materials may be found in International Publications Nos. WO 00/46854, WO 00/49421, WO 00/49658, WO 00/55915, and WO 00/55916, the entire disclosures of which are herein incorporated by reference. Apparatus, methods, and compositions for producing flexible substrates are disclosed in U.S. Pat. Nos. 5,469,020 (Herrick), U.S. Pat. No. 6,274,508 (Jacobsen et al.), U.S. Pat. No. 6,281,038 (Jacobsen et al.), U.S. Pat. No. 6,316,278 (Jacobsen et al.), U.S. Pat. No. 6,468,638 (Jacobsen et al.), U.S. Pat. No. 6,555,408 (Jacobsen et al.), U.S. Pat. No. 6,590,346 (Hadley et al.), U.S. Pat. No. 6,606,247 (Credelle et al.), U.S. Pat. No. 6,665,044 (Jacobsen et al.), and U.S. Pat. No. 6,683,663 (Hadley et al.), all of which are incorporated herein by reference.

Positioning of Plasma-tube on Substrate

The Plasma-tube may be positioned or located on the substrate by any appropriate means. In one embodiment of this invention, the Plasma-tube is bonded to the surface of a monolithic or dual-substrate display such as a PDP. The Plasma-tube may be bonded to the substrate surface with a non-conductive, adhesive material, which can also serve as an insulating barrier to prevent electrically shorting of the conductors or electrodes connected to the Plasma-tube.

The Plasma-tube may be mounted or positioned within a substrate well, cavity, hollow, or like depression. The well, cavity, hollow or depression is of suitable dimensions with a mean or average diameter and depth for receiving and retaining the Plasma-tube. As used herein, well includes cavity, hollow, depression, or any similar configuration. In U.S. Pat. No. 4,827,186 (Knauer et al.), there is shown a cavity referred to as a concavity or saddle. The depression, well or cavity may extend partly through the substrate, embedded within or extend entirely through the substrate. The cavity may comprise an elongated channel, trench, or groove extending partially or completely across the substrate.

The electrodes must be in direct contact with each Plasma-tube. An air gap between an electrode and the Plasma-tube will cause high operating voltages. A material such as a conductive adhesive, and/or a conductive filler may be used to bridge or connect the electrode to the Plasma-tube. Such conductive material must be carefully applied so as to not electrically short the electrode to other nearby electrodes. A dielectric material may also be applied to fill any air gap. This also may be an adhesive, or other suitable material.

Insulating Barrier

The insulating barrier may comprise any suitable non-conductive material, which may also be used to bond the Plasma-tube to the substrate.

In one embodiment, there is used an epoxy resin that is the reaction product of epichlorohydrin and bisphenol-A. One such epoxy resin is a liquid epoxy resin, D.E.R. 383, produced by the Dow Plastics group of the Dow Chemical Company.

Electrically Conductive Bonding Substance

In the practice of this invention, the conductors or electrodes are electrically connected to each Plasma-tube with an electrically conductive bonding substance. The electrically conductive bonding substance can be any suitable inorganic or organic material including compounds, mixtures, dispersions, pastes, liquids, cements, and adhesives. In one embodiment, the electrically conductive bonding substance is an organic substance with conductive filler material. Contemplated organic substances include adhesive monomers, dimers, trimers, polymers and copolymers of materials such as polyurethanes, polysulfides, silicones, and epoxies. A wide range of other organic or polymeric materials may be used.

Contemplated conductive filler materials include conductive metals or metalloids such as silver, gold, platinum, copper, chromium, nickel, aluminum, and carbon. The conductive filler may be of any suitable size and form such as particles, powder, agglomerates, or flakes of any suitable size and shape. It is contemplated that the particles, powder, agglomerates, or flakes may comprise a non-metal, metal, or metalloid core with an outer layer, coating, or film of conductive metal. Some specific embodiments of conductive filler materials include silver-plated copper beads, silver-plated glass beads, silver particles, silver flakes, gold-plated copper beads, gold-plated glass beads, gold particles, gold flakes, and so forth. In one particular embodiment of this invention there is used an epoxy filled with 60% to 80% by weight silver.

Examples of electrically conductive bonding substances are well known in the art. The disclosures including the compositions of the following references are incorporated herein by reference.

U.S. Pat. No. 3,412,043 (Gilliland) discloses an electrically conductive composition of silver flakes and resinous binder.

U.S. Pat. No. 3,983,075 (Marshall et al.) discloses a copper filled electrically conductive epoxy.

U.S. Pat. No. 4,247,594 (Shea et al.) discloses an electrically conductive resinous composition of copper flakes in a resinous binder.

U.S. Pat. Nos. 4,552,607 (Frey) and 4,670,339 (Frey) disclose a method of forming an electrically conductive bond using copper microspheres in an epoxy.

U.S. Pat. No. 4,880,570 (Sanborn et al.) discloses an electrically conductive epoxy-based adhesive selected from the amine curing modified epoxy family with a filler of silver flakes.

U.S. Pat. No. 5,183,593 (Durand et al.) discloses an electrically conductive cement comprising a polymeric carrier such as a mixture of two epoxy resins and filler particles selected from silver agglomerates, particles, flakes, and powders. The filler may be silver-plated particles such as inorganic spheroids plated with silver. Other noble metals and non-noble metals such as nickel are disclosed.

U.S. Pat. No. 5,298,194 (Carter et al.) discloses an electrically conductive adhesive composition comprising a polymer or copolymer of polyolefins or polyesters filled with silver particles.

U.S. Pat. No. 5,575,956 (Hermansen et al.) discloses electrically conductive, flexible epoxy adhesives comprising a polymeric mixture of a polyepoxide resin and an epoxy resin filled with conductive metal powder, flakes, or non-metal particles having a metal outer coating. The conductive metal is a noble metal such as gold, silver, or platinum. Silver-plated copper beads and silver-plated glass beads are also disclosed.

U.S. Pat. No. 5,891,367 (Basheer et al.) discloses a conductive epoxy adhesive comprising an epoxy resin cured or reacted with selected primary amines and filled with silver flakes. The primary amines provide improved impact resistance.

U.S. Pat. No. 5,918,364 (Kulesza et al.) discloses substrate bumps or pads formed of electrically conductive polymers filled with gold or silver.

U.S. Pat. No. 6,184,280 (Shibuta) discloses an organic polymer containing hollow carbon microfibers and an electrically conductive metal oxide powder.

In another embodiment, the electrically conductive bonding substance is an organic substance without a conductive filler material.

Examples of electrically conductive bonding substances are well known in the art. The disclosures including the compositions of the following references are incorporated herein by reference.

U.S. Pat. No. 5,645,764 (Angelopoulos et al.) discloses electrically conductive pressure sensitive polymers without conductive fillers. Examples of such polymers include electrically conductive substituted and unsubstituted polyanilines, substituted and unsubstituted polyparaphenylenes, substituted and unsubstituted polyparaphenylene vinylenes, substituted and unsubstituted polythiophenes, substituted and unsubstituted polyazines, substituted and unsubstituted polyfuranes, substituted and unsubstituted polypyrroles, substituted and unsubstituted polyselenophenes, substituted and unsubstituted polyphenylene sulfides and substituted and unsubstituted polyacetylenes formed from soluble precursors. Blends of these polymers are suitable for use as are copolymers made from the monomers, dimers, or trimers, used to form these polymers.

Electrically conductive polymer compositions are also disclosed in U.S. Pat. Nos. 5,917,693 (Kono et al.), 6,096,825 (Garnier), and 6,358,438 (Isozaki et al.) all incorporated herein by reference.

The electrically conductive polymers disclosed above may also be used with conductive fillers.

In some embodiments, organic ionic materials such as calcium stearate may be added to increase electrical conductivity. See U.S. Pat. No. 6,599,446 (Todt et al.), incorporated herein by reference.

In one embodiment hereof, the electrically conductive bonding substance is luminescent, for example as disclosed in U.S. Pat. No. 6,558,576 (Brielmann et al.), incorporated herein by reference.

Electrodes

The electrode interconnection array between the waveform supply and the plasma tubes is composed of minimal amounts non-metallic conductor material such as ITO film, as well as minimal amounts of other conductive materials so as to avoid the inadvertent creation of unwanted electrically conductive reflector elements. Waveform distribution electrodes made of metal may be either shielded so as not to reflect incident RF radiation, or fabricated as very fine short filament contacts that are sufficiently small so as not to reflect incident RF radiation.

One or more hollow Plasma-tubes containing the ionizable gas are located within the display panel structure, each Plasma-tube being in contact with at least two electrodes. In accordance with this invention, the contact is made by an electrically conductive bonding substance applied to each tube so as to form an electrically conductive pad for connection to the electrodes. A dielectric substance may also be used in lieu of or in addition to the conductive substance. Each electrode pad may partially cover the outside tube surface of the Plasma-tube. The electrodes and pads may be of any geometric shape or configuration. In one embodiment the electrodes are opposing arrays of electrodes, one array of electrodes being transverse or orthogonal to an opposing array of electrodes. The electrode arrays can be parallel, zigzag, serpentine, or like pattern as typically used in dot-matrix gas discharge (plasma) displays. The use of split or divided electrodes is contemplated as disclosed in U.S. Pat. Nos. 3,603,836 (Grier) and 3,701,184 (Grier), incorporated herein by reference. Apertured electrodes may be used as disclosed in U.S. Pat. Nos. 6,118,214 (Marcotte) and 5,411,035 (Marcotte) and U.S. Patent Application Publication 2004/0001034 (Marcotte), all incorporated herein by reference. The electrodes are of any suitable conductive metal or alloy including gold, silver, aluminum, or chrome-copper-chrome. If a transparent electrode is used on the viewing surface, this is typically indium tin oxide (ITO) or tin oxide with a conductive side or edge bus bar of silver. Other conductive bus bar materials may be used such as gold, aluminum, or chrome-copper-chrome. The electrodes may partially cover the external surface of the Plasma-tube.

The electrode array may be divided into two portions and driven from both sides with a so-called dual scan architecture as disclosed by Dr. Thomas J. Pavliscak in U.S. Pat. Nos. 4,233,623 and 4,320,418, both incorporated herein by reference.

A flat Plasma-sphere surface is particularly suitable for connecting electrodes to the Plasma-sphere. If one or more electrodes connect to the bottom of Plasma-sphere, a flat bottom surface is desirable. Likewise, if one or more electrodes connect to the top or sides of the Plasma-sphere, it is desirable for the connecting surface of such top or sides to be flat.

The electrodes may be applied to the substrate or to the Plasma-tubes by thin film methods such as vapor phase deposition, e-beam evaporation, sputtering, conductive doping, etc. or by thick film methods such as screen printing, ink jet printing, etc.

In a matrix display, the electrodes in each opposing transverse array are transverse to the electrodes in the opposing array so that each electrode in each array forms a crossover with an electrode in the opposing array, thereby forming a multiplicity of crossovers. Each crossover of two opposing electrodes forms a discharge point or cell. At least one hollow Plasma-tube containing ionizable gas is positioned in the gas discharge (plasma) display device at the intersection of at least two opposing electrodes. When an appropriate voltage potential is applied to an opposing pair of electrodes, the ionizable gas inside of the Plasma-tube at the crossover is energized and a gas discharge occurs. Photons of light in the visible and/or invisible range are emitted by the gas discharge.

Plasma-shell Geometry

The shell of the Plasma-shells may be of any suitable volumetric shape or geometric configuration to encapsulate the ionizable gas independently of the PDP or PDP substrate. As used herein, Plasma-shell includes Plasma-sphere, Plasma-disc, and/or Plasma-dome. The volumetric and geometric shapes include but are not limited to spherical, oblate, spheroid, prolate spheroid, capsular, elliptical, ovoid, egg shape, bullet shape, pear and/or tear drop. In an oblate spheroid, the diameter at the polar axis is flattened and is less than the diameter at the equator. In a prolate spheroid, the diameter at the equator is less than the diameter at the polar axis such that the overall shape is elongated. Likewise, the shell cross-section may be of any geometric design.

The size of the Plasma-shell used in the practice of this invention or discharge distance may vary over a wide range. In a gas discharge display, the average diameter of a Plasma-shell is about 1 mil to 20 mils (where one mil equals 0.001 inch) or about 25 microns to 500 microns where 25.4 microns (micrometers) equals 1 mil or 0.001 inch. Plasma-shells can be manufactured up to 400 mils or about 10,000 microns in diameter or greater. The thickness of the wall of each hollow Plasma-shell must be sufficient to retain the gas inside, but thin enough to allow passage of photons emitted by the gas discharge. The wall thickness of the Plasma-shell should be kept as thin as practical to minimize photon absorption, but thick enough to retain sufficient strength so that the Plasma-shells can be easily handled and pressurized.

Plasma-tubes

The PDP structure may comprise Plasma-tubes alone or a combination of Plasma-shells and Plasma-tubes. Plasma-tubes comprise elongated tubes for example as disclosed in U.S. Pat. Nos. 3,602,754 (Pfaender et al.), 3,654,680 (Bode et al.), 3,927,342 (Bode et al.), 4,038,577 (Bode et al.), 3,969,718 (Stom), 3,990,068 (Mayer et al.), 4,027,188 (Bergman), 5,984,747 (Bhagavatula et al.), 6,255,777 (Kim et al.), 6,633,117 (Shinoda et al.), 6,650,055 (Ishimoto et al.), 6,677,704 (Ishimoto et al.), 7,122,961 (Wedding), 7,157,854 (Wedding), and 7,126,628 (Wedding), all incorporated herein by reference.

As used herein, the elongated Plasma-tube is intended to include capillary, filament, filamentary, illuminator, hollow rod, or other such terms. It includes an elongated enclosed gas-filled structure having a length dimension that is greater than its cross-sectional width dimension. The width of the Plasma-tube is the viewing width from the top or bottom (front or rear) of the display.

The length of each Plasma-tube may vary depending upon the PDP structure. In one embodiment hereof, an elongated tube is selectively divided into a multiplicity of lengths. In another embodiment, there is used a continuous tube that winds or weaves back and forth from one end to the other end of the PDP. The length of the Plasma-tube is typically about 1400 microns to several feet or more.

The PDP may comprise any suitable combination of Plasma-shells and Plasma-tubes. The Plasma-tubes may be arranged in any configuration. In one embodiment, there are alternative rows of Plasma-shells and Plasma-tubes. The Plasma-tubes may be used for any desired function or purpose including the priming or conditioning of the Plasma-shells. In one embodiment, the Plasma-tubes are arranged around the perimeter of the display to provide priming or conditioning.

The Plasma-tubes may be of any geometric cross-section including circular, elliptical, square, rectangular, triangular, polygonal, trapezoidal, pentagonal, or hexagonal. In one preferred embodiment, the viewing surface of the Plasma-tube is flat. In another embodiment, each electrode-connecting surface such as top, bottom, and/or side(s) is flat.

The Plasma-tube may be made of any suitable material, and may contain secondary electron emission materials, luminescent materials, and reflective materials as discussed herein for Plasma-shells. The Plasma-tubes may also utilize positive column discharge as discussed herein for Plasma-shells.

SUMMARY

Aspects of this invention may be practiced with a coplanar or opposing substrate PDP as disclosed in the U.S. Pat. Nos. 5,793,158 (Wedding) and 5,661,500 (Shinoda et al.) or with a single-substrate or monolithic PDP as disclosed in the U.S. Pat. Nos. 3,646,384 (Lay), 3,860,846 (Mayer), 3,935,484 (Dick et al.) and other single substrate patents, discussed above and incorporated herein by reference.

In the practice of this invention, the Plasma-tubes may be positioned and spaced in an AC gas discharge plasma display structure so as to utilize and take advantage of the positive column of the gas discharge. The positive column is described in U.S. Pat. No. 6,184,848 (Weber) and the Carol A. Wedding patents cited above and are incorporated herein by reference. In a positive column application, the Plasma-tubes must be sufficient in length along the discharge axis to accommodate the positive column discharge.

Although this invention has been disclosed and described above with reference to dot matrix gas discharge displays, it may also be used in an alphanumeric gas discharge display using segmented electrodes. This invention may also be practiced in AC or DC gas discharge displays including hybrid structures of both AC and DC gas discharge.

The foregoing description of various preferred embodiments of the invention has been presented for purposes of illustration and description. It is not intended to be exhaustive or to limit the invention to the precise forms disclosed. Obvious modifications or variations are possible in light of the above teachings. The embodiments discussed were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims to be interpreted in accordance with the breadth to which they are fairly, legally, and equitably entitled.

The invention claimed is:

1. A phased array Plasma-tube antenna characterized by a plurality of localized gas discharge areas, each gas area being selectively and sufficiently ionized to form a reflector to incident radiation, each localized gas discharge area being confined within a gas encapsulating Plasma-tube, each Plasma-tube affixed to a substrate, at least two or more electrodes in contact with each gas encapsulating Plasma-tube, said electrodes being affixed to or embedded within the substrate, and electronic circuitry including PDP addressing and sustain waveform electronics for addressing and sustaining the electrodes so as to selectively ionize a gas within a Plasma-tube and produce a controllable level of electron density over time within each Plasma-tube, a selected portion of each Plasma-tube acting alone or in concert with a selected portion of one or more other Plasma-tubes to form dipoles or patterns of dipoles.

2. The invention of claim 1 in which the position, length, and/or spacing of the Plasma-tube dipoles are selected to efficiently reflect incident radiation at a desired angle.

3. The invention of claim 1 in which a ground plane structure resides on one or more layers on the substrate.

4. The invention of claim 1 in which the electronic circuitry includes a high frequency voltage component, said frequency ranging from about 1 megahertz to about 100 megahertz.

5. The invention of claim 1 wherein the substrate is rigid.

6. The invention of claim 1 wherein the substrate is flexible.

7. The invention of claim 1 wherein the substrate is semi-flexible.

8. The invention of claim 1 wherein the Plasma-tube antenna comprises a single substrate with each Plasma-tube being affixed to said substrate.

9. A radio frequency (RF) phasing structure for electromagnetically emulating a desired reflective surface of selected geometry over at least one operating frequency band, which comprises:

reflective means for reflecting energy of an incident RF beam within the at least one frequency band;

a phasing arrangement of at least one plasma panel structure that is operatively coupled to the reflective means, the at least one plasma panel structure including at least one gas containing area confined within a Plasma-tube, said gas area being reflective at the at least one operating frequency range when the gas is ionized, the ionized gas within the Plasma-tube being disposed at a distance from the reflective means and having a size associated therewith whereby the phasing structure generates a reflected RF beam with a phase shift imparted thereon in response to the incident RF beam so as to provide the emulation of the desired reflective surface of selected geometry; and control circuit for dynamically varying the size of the at least one ionized plasma area such that the phase shift imparted on the reflected RF beam dynamically varies so that the reflected RF beam is electronically scanned.

10. The invention of claim 9 wherein the phasing arrangement further includes a plurality of ionized plasma areas, each ionized plasma area being disposed a first distance from the reflective means and having a size associated therewith, each ionized plasma area further being disposed a second distance from each adjacent ionized plasma area, whereby each ionized plasma area, in cooperation with the reflective means, generates a portion of the reflected RF beam having a phase shift imparted thereon in response to the incident RF beam so as to generate a composite RF beam having a scan angle associated therewith.

11. The invention of claim 10 wherein each ionized plasma area is disposed, with respect to adjacent ionized plasma areas, a distance equivalent to approximately one half of a wavelength associated with the at least one operating frequency band.

12. The invention of claim 9 further including a second reflective means disposed a distance from the ionized plasma areas for reflecting energy of an incident RF beam within a second operating frequency band.

13. The invention of claim 9 wherein the phasing arrangement further includes a second ionized plasma area being disposed a first distance from the reflective means and second distance from the at least one ionized plasma area and having a size associated therewith whereby the at least one ionized plasma area and second ionized plasma area impart a composite phase shift on the reflected RF beam formed from a combination of the individual phase shifts provided by each plasma area.

14. The invention of claim 9 wherein the at least one ionized plasma area forms a radiating element in the form of a dipole.

15. The invention of claim 14 wherein the control circuit dynamically varies a length of the dipole in order to dynamically vary the phase shift imparted on the reflected RF beam.

16. The invention of claim 9 wherein the at least one plasma structure has a planar geometry.

17. The invention of claim 9 wherein the desired reflective surface is a parabolic reflector.

18. The invention of claim 9 wherein the reflective means includes a ground plane structure.

* * * * *